US012514337B2

(12) United States Patent
Devalve

(10) Patent No.: US 12,514,337 B2
(45) Date of Patent: Jan. 6, 2026

(54) ATHLETIC CLEAT

(71) Applicant: SEBOS, LLC, Weehawken, NJ (US)

(72) Inventor: Seth N. Devalve, Weehawken, NJ (US)

(73) Assignee: Sebos, LLC, Weehawken, NJ (US)

( * ) Notice: Subject to any disclaimer, the term of this patent is extended or adjusted under 35 U.S.C. 154(b) by 0 days.

(21) Appl. No.: 18/568,200

(22) PCT Filed: Jun. 10, 2022

(86) PCT No.: PCT/US2022/032990
§ 371 (c)(1),
(2) Date: Dec. 7, 2023

(87) PCT Pub. No.: WO2022/261425
PCT Pub. Date: Dec. 15, 2022

(65) Prior Publication Data

US 2024/0306775 A1 Sep. 19, 2024

Related U.S. Application Data

(60) Provisional application No. 63/209,189, filed on Jun. 10, 2021.

(51) Int. Cl.
*A43C 15/16* (2006.01)
*A43B 13/12* (2006.01)

(52) U.S. Cl.
CPC ..... *A43C 15/162* (2013.01); *A43B 13/12* (2013.01)

(58) Field of Classification Search
CPC ..... A43B 7/1495; A43B 7/24; A43B 13/026; A43B 13/223; A43B 13/12; A43B 13/41; A43B 13/122; A43B 13/42; A43B 13/141; A43B 23/0235; A43C 15/16;
(Continued)

(56) References Cited

U.S. PATENT DOCUMENTS 1,484,785 A * 2/1924 Hiss ..... A43B 13/12 36/76 R
3,999,558 A * 12/1976 Barnwell ..... A43B 7/22 36/145

(Continued)

OTHER PUBLICATIONS

International Search Report and Written Opinion for International Patent Application No. PCT/US2022/032990, received Sep. 8, 2022, 10 pages.

(Continued)

*Primary Examiner* — F Griffin Hall
(74) *Attorney, Agent, or Firm* — Morgan, Lewis & Bockius LLP

(57) ABSTRACT

An athletic cleat includes a sole structure that includes a base for receiving a user's foot. The base includes a top surface and a bottom surface opposed from the top surface. The base further includes a heel section, midfoot section, a forefoot section, and a plurality of studs extending downwardly from the bottom surface. The forefoot section includes a toe box configured to be positioned below toes of a user. The toe box includes a medial inner side edge configured to extend substantially along a length of a proximal phalanx of the user's great toe, the medial inner side edge of the toe box being aligned with a medial axis, and the medial axis being tangent to an inner side edge of the heel section.

19 Claims, 14 Drawing Sheets

(58) Field of Classification Search
CPC ... A43C 15/162; A43C 15/164; A43C 15/165; A43C 15/167
See application file for complete search history.

(56) References Cited

U.S. PATENT DOCUMENTS

| | | | | |
|---|---|---|---|---|
| 4,224,750 | A * | 9/1980 | Delport | A43B 7/141 36/91 |
| 5,709,954 | A | 1/1998 | Lyden et al. | |
| 6,910,287 | B2 * | 6/2005 | Truelsen | A43B 13/125 36/108 |
| 6,954,998 | B1 * | 10/2005 | Lussier | A43B 13/141 36/31 |
| 7,096,605 | B1 * | 8/2006 | Kozo | A43B 7/26 36/76 R |
| 7,487,604 | B2 * | 2/2009 | Perron, Jr. | A43B 5/02 36/108 |
| 7,802,379 | B2 * | 9/2010 | Gerber | A43B 13/026 36/134 |
| 7,814,683 | B2 * | 10/2010 | Lee | A43B 21/30 36/28 |
| 7,845,095 | B2 * | 12/2010 | Langvin | A43B 13/187 36/154 |
| 8,984,775 | B2 * | 3/2015 | Dombrow | A43B 23/0295 36/76 R |
| 8,997,381 | B2 * | 4/2015 | Auger | A43C 15/167 36/134 |
| 9,179,738 | B2 * | 11/2015 | Rustam | A43B 13/122 |
| 9,210,967 | B2 * | 12/2015 | Gerber | A43B 13/12 |
| 9,707,119 | B2 * | 7/2017 | Berns | A43B 7/14 |
| 9,936,765 | B2 * | 4/2018 | Sato | A43B 13/186 |
| 10,349,700 | B2 * | 7/2019 | Amis | B29D 35/124 |
| 11,044,964 | B2 * | 6/2021 | Meeker | A43D 25/00 |
| 11,234,488 | B2 * | 2/2022 | Amis | A43B 23/027 |
| 11,779,077 | B2 * | 10/2023 | Paterson | A43B 7/14 36/25 R |
| 12,082,642 | B2 * | 9/2024 | Diard | A43B 13/026 |
| 2003/0192199 | A1 | 10/2003 | Nakano et al. | |
| 2009/0300943 | A1 * | 12/2009 | Hsieh | A43B 13/41 36/43 |
| 2012/0102786 | A1 * | 5/2012 | True | A43B 5/025 36/114 |
| 2012/0180343 | A1 | 7/2012 | Auger et al. | |
| 2018/0140052 | A1 | 5/2018 | Madore | |
| 2019/0174873 | A1 | 6/2019 | Baucom et al. | |
| 2020/0383426 | A1 | 12/2020 | Bunnell et al. | |

OTHER PUBLICATIONS

Nike, "Nike Vapor Edge Pro 360", Web page, retrieved Jun. 8, 2022, 3 pages.

Adidas, "Predator Freak.3 Laceless Firm Ground Cleats," Web page, https://www.adidas.com/us/predator-freak.3-laceless-firm-ground-cleats/FY1034.html, retrieved Jun. 8, 2022, 4 pages.

* cited by examiner

ATHLETIC CLEAT

CROSS-REFERENCE TO RELATED APPLICATIONS

This application is a 371 National Stage entry of International Patent Application No. PCT/US2022/032990 filed Jun. 10, 2022, that claims the benefit of the U.S. Provisional Patent Application No. 63/209,189 filed Jun. 10, 2021 entitled "Athletic Cleat", each of which is incorporated by reference herein in its entirety.

TECHNICAL FIELD

The present disclosure generally relates to footwear and, more particularly, to an athletic cleat having a sole structure with a more natural foot shape and lateral stability structures.

SUMMARY

In one embodiment there is an athletic cleat including a sole structure including a base configured to receive a user's foot, the base having a top surface and a bottom surface opposed from the top surface, the base including a heel section, midfoot section, a forefoot section, and a plurality of studs extending downwardly from the bottom surface. The forefoot section includes a toe box configured to be positioned below toes of a user, the toe box including a medial inner side edge configured to extend substantially along a length of a proximal phalanx of a user's great toe, the medial inner side edge of the toe box being aligned with a medial axis, and the medial axis being tangent to an inner side edge of the heel section.

In some embodiments, the athletic cleat further includes a support wall extending around at least a portion of an outer periphery if the sole structure. The support wall includes a first medial support section coupled to the forefoot section of the base and extending upwardly from the top surface of the base aligned with the medial axis, the first medial support section extending rearwardly from the medial inner side edge of the toe box and configured to extend substantially along a length of a first metatarsal of the user's foot, a first lateral support section coupled to and extending upwardly from the top surface of the forefoot section of the base opposite the first medial support section, a second medial support section coupled to and extending upwardly from the heel section of the base and aligned with the medial axis, a second lateral support section coupled to and extending upwardly from the heel section of the base opposite the second medial support section.

In some embodiments, the toe box is positioned forward of the first medial support section and the first lateral support section, the support wall including a vertical section extending around a periphery of the toe box from the first medial support section to the first lateral support section. In some embodiments, the support wall further includes a second vertical section extending around a periphery of the heel section from the second medial support section to the second lateral support section. In some embodiments, the first medial support section, first lateral support section, second medial support section, second lateral support section, first vertical section and second vertical section are integrally formed. In some embodiments, the first medial support section, the first lateral support section, the second medial support section, and the second lateral support section are configured to prevent a user's foot from being laterally displaced past an outer periphery of the base during lateral movements.

In some embodiments, the first lateral support section extends rearwardly from the toe box and is concave. In some embodiments, the midfoot section includes a lateral side having a convex curvature and a medial side having a concave curvature. In some embodiments, the athletic cleat further includes a reinforcement member coupled to the top surface of the base and extending along the heel section, midfoot section and forefoot section. In some embodiments, the reinforcement member includes a first section extending along the heel section and midfoot section, and three or more members extending from the first section along the forefoot section, the three or more members spaced from one another along a direction generally perpendicular to a transverse axis extending from the second medial support section and second lateral support section.

In some embodiments, the reinforcement member includes a first section extending along the heel section and midfoot section, and three members extending from the first section along the forefoot section, each of the three members spaced from one another along a direction generally perpendicular to a transverse axis extending from the second medial support section and second lateral support section. In some embodiments, the first section of the reinforcement member is configured to prevent the base from bending along a direction parallel to and perpendicular to the transverse axis. In some embodiments, the three or more members are each configured to prevent the base from bending along a longitudinal axis extending from the midfoot section to the forefoot section of the base.

In some embodiments, the reinforcement member is comprised of a material that is more rigid than the sole structure. In some embodiments, the reinforcement member is comprised of one or more of steel, aluminum, semi-crystalline polymers, amorphous polymers, metal alloys, composite materials, aramid, carbon fiber, fiberglass, and acrylonitrile butadiene styrene (ABS), polyethylene vinyl acetate (PEVA). In some embodiments, the athletic cleat further includes an upper coupled to the base, the upper configured to cover the foot of the user wearing the athletic cleat, the upper comprised of a non-elastic material. In some embodiments, the base, the first medial support section, the first lateral support section, the second medial support section, and the second lateral support section are comprised of an elastomeric urethane. In some embodiments, the base has a thickness within a range of about 3 mm to about 6 mm. In some embodiments, the plurality of studs are coupled to a bottom surface of the base proximal the forefoot section and heel section, the plurality of studs proximal the toe box of the forefoot section aligned with an outer periphery of the reinforcement member, each stud of the plurality of studs having a generally frustoconical shape.

In another embodiment, there is an athletic cleat including a sole structure that includes a base for receiving a user's foot, the base having a top surface and a bottom surface opposed from the bottom surface, the base including a heel section, midfoot section, a forefoot section, and a plurality of studs extending downwardly from the bottom surface, the forefoot section including a toe box configured to be positioned below toes of a user, the toe box including a medial side configured to extend substantially along a length of a proximal phalanx of a user's great toe and aligned with a medial axis, the medial axis being tangent to an outer edge of the heel section. The sole structure further includes a support wall extending at least partially around a periphery of the base. The support wall includes a first medial support section coupled to the forefoot section of the base and extending upwardly from the top surface of the base aligned with the medial axis, the first medial support section extending rearwardly from the medial side of the toe box and configured to extend substantially along a length of a first metatarsal of the user's foot, a first lateral support section coupled to and extending upwardly from the forefoot section of the base opposite the first medial support section, a second medial support section coupled to and extending upwardly from the heel section of the base, a second lateral support section coupled to and extending upwardly from the heel section of the base opposite the second medial support section, and a vertical section extending upwardly from and around a periphery of the toe box, the vertical section extending from the first medial support section to the first lateral support section. The athletic cleat further includes an upper coupled to the sole structure and configured to cover the foot of the user wearing the athletic cleat, the upper comprised of a non-elastic material. The midfoot section includes a lateral side having a convex curvature and a medial side having a concave curvature.

In some embodiments, the upper includes one or more pairs of apertures for receiving a shoelace, the one or more pairs of apertures configured to extend from above where a proximal phalanx of a user's toes meets a corresponding metatarsal of the user's foot to an opening in the upper configured to receive the user's foot. In some embodiments, the first lateral support section extends rearwardly from the toe box and is concave.

BRIEF DESCRIPTION OF THE DRAWINGS

The following detailed description of embodiments of the athletic cleat, will be better understood when read in conjunction with the appended drawings of an exemplary embodiment. It should be understood, however, that the invention is not limited to the precise arrangements and instrumentalities shown.

In the drawings.

DETAILED DESCRIPTION

Figure 1:
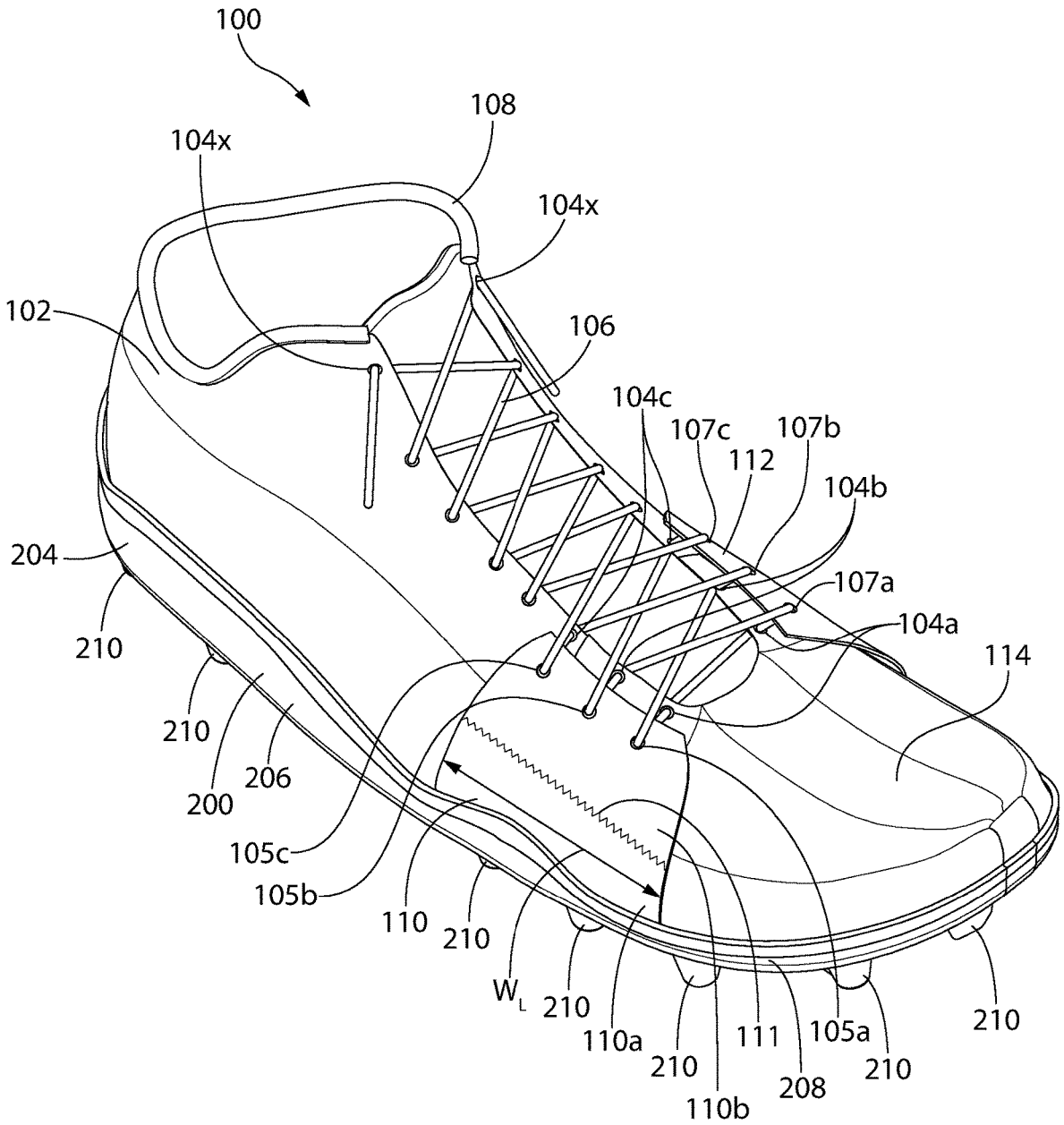
FIG. 1A is a perspective view of an athletic cleat in accordance with an exemplary embodiment of the present disclosure.
FIG. 1B is a magnified perspective view of the athletic cleat of FIG. 1A.
FIG. 1C is a bottom perspective view of a lasting board and single support strap for use with the athletic cleat of FIG. 1A in accordance with an exemplary embodiment of the present disclosure.

Conventional athletic footwear, such as, but not limited to cleated footwear, typically includes a toe box which narrows from where the ball of the foot is positioned to the front of the toe box where the end of the toes are positioned. Toe boxes which narrow often cause the toes of the user to adduct which reduces the stability of the athletic footwear and negatively impacts the wearer's ability to produce longitudinal power when walking or running. Furthermore, repeated use of athletic footwear having a toe box that narrows or tapers from the ball of the foot to the distal end of the toes may cause the toes of the user to permanently be adducted which may lead to discomfort, orthopedic injuries and/or impairments. Existing athletic footwear that is marketed as having a "wide fit" typically refers to the distance from the lateral and medial sides where the ball of the foot is placed being widened, however such "wide fit" athletic footwear still includes a taper that extends from the ball of the foot to the ends of the user's toes. In this manner, existing athletic footwear, whether marketed as having a "wide fit" or not, results in adduction of the user's toes.

Additionally, conventional athletic footwear often lacks lateral stability causing poor traction and loss of lateral power production when worn by a user. For example, during lateral movements, the user's foot may shift within the shoe such that the lateral or medial edge of the user's foot extends beyond a lateral or medial edge of the sole of the shoe. Such a shift outside an edge of the outsole results in a loss of energy recoil, requiring the athlete to have to produce additional force to overcome these losses. Such a shift may also lead to injuries such as broken or sprained ankles. The shift of the user's foot beyond the lateral or medial edges of the sole may also result from a lack of lateral stability in combination with improvements to the traction of the athletic cleat. There may be diminishing returns to improvements on traction technology (e.g., shape, position, and/or material of studs) if lateral stability is not also improved in parallel. As such, the athletic cleat of the present disclosure is configured to increase lateral stability to better match innovations and improvements in traction technology and/or the increasing athletic abilities of athletes.

Previous improvements to the traction, such as lateral traction, of athletic cleats involved altering the shape and configuration of the studs which extend from the bottoms of the athletic cleats from a conical shape to other shapes such as rectangular and triangular shapes. As traction increases, the risk of the user's foot shifting within conventional athletic cleats also increases thereby further increasing the risk of energy recoil loss. For example, as traction increases the user's foot may not decelerate as quickly as the outsole upon which the studs are attached, resulting in energy recoil loss and/or decreased lateral stability. Altering the shape and configuration of the studs may increase lateral and longitudinal traction, however such an alteration often also negatively affects the user's ability to move in the transverse plane (e.g., twisting movements). This negative impact may increase the likelihood of the user experiencing a common knee and/or hip injury. Additionally, conventional athletic footwear often includes soles having multiple layers of padding, corrugated outsoles, and/or fluted outsole which increases the overall thickness of the sole and causes the user's foot to be higher from the ground. As the user's foot is raised higher off the ground lateral stability decreases and the risk that the user's ankle will roll during lateral movements increases.

Therefore, the present disclosure includes an athletic cleat having a widened toe box sized to allow a user's toes to be received within the toe box without causing the user's toes to be adducted. The athletic cleat of the present disclosure also provides lateral stability by providing a sole structure having a convex lateral edge and one or more support structures extending upwardly therefrom. The one or more support structures may be configured to allow the user's foot to decelerate at generally the same rate as the outsole, also referred to as a sole structure, thereby reducing the risk of energy recoil loss and/or increasing lateral stability when compared to conventional athletic footwear. The athletic cleat of the present disclosure also provides lateral stability without compressing the user's toes. For example, the athletic footwear of the present disclosure may include a support wall having one or more support sections disposed proximal the joint between the metatarsal and corresponding proximal phalange of the user's foot configured to lock the user's foot in place while allowing the toes to be generally free to move within the toe box. Additionally, the athletic footwear of the present disclosure may include a lateral and medial edge strap for locking down the user's foot in a position which allows the user's toes to be generally free to move within the toe box. The athletic cleat of the present disclosure also provides a sole structure which has a thickness which is less than conventional athletic shoes such that a user's foot is closer to the ground to aid in preventing a user's ankle from rolling during use of the athletic cleat.

Referring to the drawings in detail, wherein like reference numerals indicate like elements throughout, there is shown in FIGS. 1A-12 an athletic cleat, generally designated 100, having a sole structure, generally designated 200, in accordance with an exemplary embodiment of the present disclosure. In the disclosure herein, features of the athletic cleat 100, including the sole structure 200, are described with reference to various sections of the foot of a user wearing the athletic cleat 100. The dimensions (e.g., length and width) of the various sections of the user's foot is dependent upon the size of the user's foot. For example, the distance between the heel and ball of the foot is different for users with different foot sizes. The foot size of the user's foot may correspond to a shoe size which best matches the foot size of the user. It will be understood that athletic cleat 100, and the features thereof described herein, are sized to closest match the foot size of the user. In some embodiments, the dimensions of the athletic cleat 100 may be custom sized to the user's foot or manufactured to one or more predetermined sizes corresponding to existing standard sizing (e.g., U.S. standard sizing). In some embodiments, the athletic cleat 100 includes a widened toe box and is configured to increase lateral stability and/or lateral traction of the user. It will be understood that lateral stability and lateral traction, with regards to an athletic cleat, are related to and different from one another. For example, lateral traction may refer to the grip of the athletic cleat 100 on a surface (e.g., a playing surface such as the ground and/or artificial turf) whereas lateral stability may refer to how well a user's foot stays within the periphery of a sole structure of the athletic cleat during various movements (e.g., frontal plane movements). Frontal plane movements refer to movements that are dominant in the frontal plane, which will be understood as one of the three planes of motion of the body that include the frontal plane, sagittal plane, and transverse plane. As such, when referring to frontal, sagittal, or transverse movements, it will be understood that such movements are dominant in the respective planes of motion of the body.

Figure 1B:
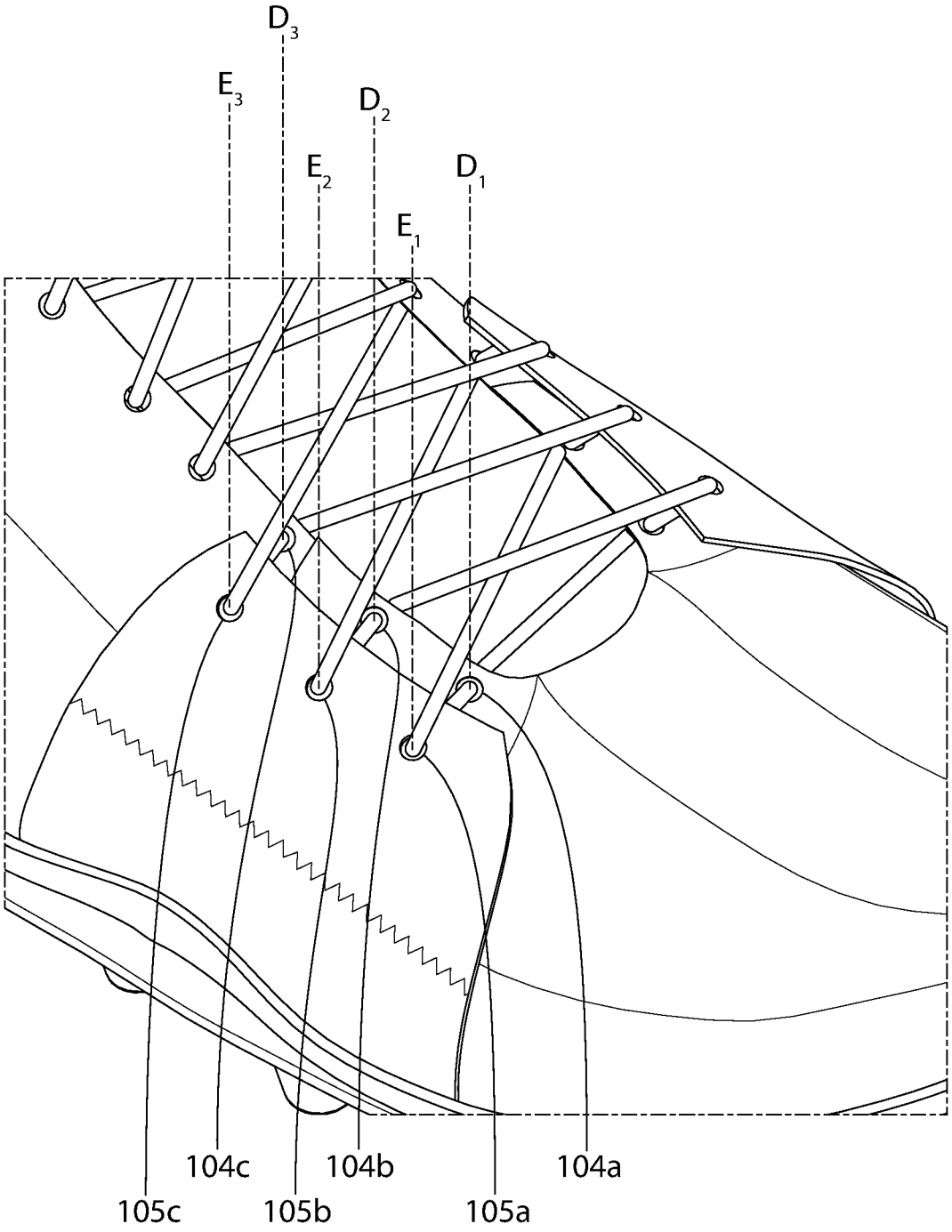

Referring to FIGS. 1A-1B, there is shown an athletic cleat 100 having an upper 102, and a sole structure 200. The upper 102 may be configured to cover the foot of a user wearing the athletic cleat. The upper 102 may include a lacing system for securing the athletic cleat 100 on the foot of the user. In some embodiments, the lacing system may include one or more pairs of apertures 104*a*-104*x* for receiving a shoelace 106. In some embodiments, the one or more pairs of apertures 104*a*-104*x* may be pairs of eyelets, a pair of hooks, or a combination thereof. The upper 102 may include an opening 108 positioned at the cuff of the athletic cleat 100 allowing the user to place their foot in the athletic cleat 100. The upper 102 may be configured to provide layer of padding and/or cushioning between the user's foot and the inner surface of the sole structure 200. For example, the upper 102 may be positioned between the user's foot and an inner surface of the sole structure 200. In some embodiments, the upper 102 may include at least one of a foam, mesh, or leather material.

In some embodiments, the one or more pairs of apertures 104*a*-104*x* may extend from above where a proximal phalanx of a user's toe's meets a corresponding metatarsal of the user's foot to proximal the opening 108. For example, in FIGS. 1A-1B an initial pair of apertures 104*a* are positioned on the upper 102 above where a proximal phalanx of the user's toe (e.g., proximal phalanx of great toe) meets the corresponding metatarsal (e.g., first metatarsal) of the user's foot. A terminal pair of apertures 104*x* are positioned proximal the opening 108. The pair of apertures 104*a*-104*x* may include any number of intermediary apertures (e.g., 104*b*-104*y*) extending along the upper 102 between the initial pair of apertures 104*a* to the terminal pair of apertures 104*x*.

In some embodiments, the upper 102 includes a lateral support strap 110 and a medial support strap 112 positioned opposite the lateral support strap 110 for securing the foot of a user relative to the sole structure 200. In some embodiments, the lateral support strap 110 extends from a lateral side of the sole structure 200 upwards along an outer surface 114 of upper 102 toward one or more pairs of apertures (e.g., pairs of apertures 104*a*-104*c*). In some embodiments, the lateral support strap 110 extends from a lateral side of sole structure 200 upward along the outer surface 114 of upper 102 toward the apertures 104*a*-104*c*. Similarly, the medial support strap 112 may extend from a medial side of the sole structure 200 upward along the outer surface 114 of upper 102 toward the apertures 104*a*-104*c*.

In some embodiments, the lateral support strap 110 may include one or more eyelets 105*a*-105*c* configured to receive the shoelaces 106 that are laced through the apertures 104 in the upper 102. Similarly, the medial support strap 112 may include one or more eyelets 107*a*-107*c* configured to receive the shoelaces 106 that are laced through the apertures 104 in the upper 102. In some embodiments, the eyelets 105*a*-105*c* and eyelets 107*a*-107*c* may be offset from the corresponding apertures 104*a*-104*c* in the upper 102. For example, the eyelets 105*a*-105*c* and eyelets 107*a*-107*c* may not overlap the corresponding apertures 104*a*-104*c*. Put another way, central axes that each of the apertures 104*a*-104*c* extends circumferentially around respectively may be offset from the central axes that each of the eyelets 105*a*-105*c*, 107*a*-107*c* extend circumferentially around. For example, the apertures 104*a*-104*c* may extend circumferentially around central axes $D_1$-$D_3$ respectively and the eyelets 105*a*-105*c* may extend circumferentially around central axes $E_1$-$E_3$ respectively, as illustrated in FIG. 1B. Each of the said axes $D_1$-$D_3$ may be offset from a corresponding central axes $E_1$-$E_3$.

By providing the eyelets 105*a*-105*c* and eyelets 107*a*-107*c* that are offset from the corresponding apertures 104*a*-104*c* in the upper 102, the customizability, fit, and/or tightness of the athletic cleat 100 to a user's foot may be improved when compared to conventional athletic cleats. For example, when opposing ends of the shoelaces 106 a pulled tightly together by the user, the shoelaces 106 may pull the eyelets 105*a*-105*c* and eyelets 107*a*-107*c* toward one another thereby causing the lateral and medial support straps 110, 112 to be pulled toward one another. This may result in a "cinching" effect where the lateral support straps 110, 112, and the corresponding portion of the upper 102 positioned below said support straps 110, 112, are tightened and/or compressed against the top of the user's foot. In some embodiments, the shoelaces 106 may be replaced by one or more straps having hook and loop fasteners included therewith.

In some embodiments, the lateral and medial support straps 110, 112 are coupled to the outer surface 114 of upper 102 such that at least a portion of each may act as a flap. A portion of each of the lateral and medial support straps 110, 112 may be fixedly coupled to the upper via one or more fastening means while a remaining portion of each of the straps 110, 112 may not. For example, the first lateral support strap 110 may be fastened to the upper 102 via stitching 111 that is positioned between the sole structure 200 and the eyelets 105*a*-105*c*. As such, there may be a first portion 110*a* of the lateral support strap 110 positioned between the stitching 111 and the sole structure 200, and a second portion 110*b* positioned above the stitching 111 opposite the first portion 110*a*. The second portion 110*b* may act as a flap that may freely bend, rotate, or flex relative to the upper 102. Put another way, the position and/or orientation of the second portion 110*b* may not be fixed relative to the upper 102. By providing a second portion 110*b* of the lateral support strap 110 that is able to bend and/or flex relative to the upper 102, the comfortability and/or fit of the athletic cleat 100 to the user's foot may be improved when compared to conventional athletic cleats. For example, the second portion 110*b* may allow the cinching effect, described in the preceding paragraph, to occur without causing bunching or excessive bending of the upper 102 as the shoelaces 106 are pulled tightly together. In some embodiments, the position of the stitching 111 along the first lateral support strap 110 (and the stitching on the corresponding second lateral support strap 112) relative to the sole structure 200 may be altered to adjust how much of the lateral support strap 110 may bend relative to the upper 102. Put another way, the stitching may be moved towards or away from the sole structure 200 from what is shown in FIG. 1A thereby increasing or reducing the size of the second portion 110*b*.

The position and/or orientation of the first portion 110*a* of the lateral support strap 110 may generally remain fixed relative to the upper 102, however it will be understood that the first portion 110*a* may bend and/or flex somewhat or to a significantly lesser degree than the second portion 110*b*. For example, the periphery of the lateral support strap 110 that extends between the stitching 111 and the sole structure 200 may not include any stitching thereby allowing the first portion 110*a* to bend and/or flex relative to the upper 102. In other embodiments, there is stitching extending along the portion of the periphery of the lateral support strap 110 that extends between the stitching 111 and the sole structure 200. Although not shown, it will be understood that the medial support strap 112 may include generally the same features as the lateral support strap 110 with regards to, at least, the stitching 111 and the first and second portions 110*a*, 110*b*. For example, the medial support strap 112 may be stitched to the upper 102 in generally the same manner as the lateral support strap 110 and have a portion thereof that may freely bend and/or flex relative to the upper 102.

In some embodiments, the lateral and medial support straps 110, and 112 have generally the same shape and size. In other embodiments, the size of the medial support strap 112 may be less than the size of the lateral support strap 110. For example, the length of the medial support strap 112, as measured along the surface of the medial support strap 112 from the sole structure 200 to a terminal end of the strap 112 proximate the eyelets 107*a*-107*c* may be less than the length of the lateral support strap 110 measured in generally the same manner. In some embodiments, the lateral and medial support straps 110, 112 are coupled to sole structure 200. For example, the lateral and medial support straps 110, 112 may be fixedly coupled to the sole structure 200. In some embodiments, the lateral support strap 110 is coupled to the sole structure 200 along a surface area defined partially by a width $W_L$ of the lateral support strap 110 as measured in a direction perpendicular to opposing side walls of the lateral support strap 110 The surface area may be fully defined by depth of the lateral support strap 110 defined by the length of the portion of strap 110 that abuts the inner surface of the sole structure 200. The width $W_L$ may be between about 50 mm and about 90 mm and the depth may be between about 50 mm and 72 mm. Although not shown, the medial support strap 112 may be fixedly coupled to the sole structure along a surface area that is generally equal to the surface area within which the lateral support strap 110 is coupled to the sole structure. In some embodiments, the first lateral support strap 110 may have a surface area defined by the outwardly facing surface of the lateral support strap 110 between about 3500 square millimeters to about 5000 square millimeters.

Figure 1C:
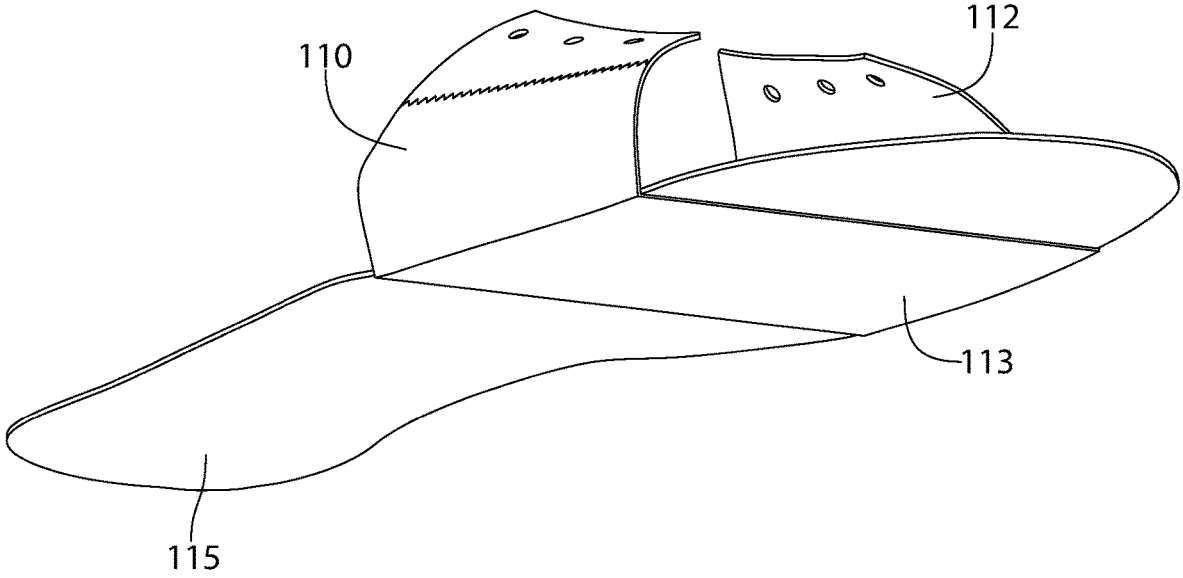

Referring to FIGS. 1A and 1C, in some embodiments, the lateral and medial support straps 110, 112 may be coupled to one another and/or configured to be decoupled from the athletic cleat 100. For example, the lateral and medial support straps 110, 112 may not be stitched or fixedly coupled to the upper 102 and/or the sole structure 200. In such embodiments, there may be one or more straps extending between and coupled to each of the lateral and medial support straps 110, 112. In some embodiments, the lateral and medial support straps 110, 112 and the one or more other straps may be integrally formed. In embodiments where the one or more other straps coupling the lateral and medial support straps 110, 112 may be configured to abut the top surface of the sole structure 200 and extend along the width of the sole structure 200 between the lateral and medial sides thereof. Put another way, the lateral and medial support straps 110, 112 may be a single strap having an intermediate portion 113 that is configured to abut and extend around the width of the sole structure 200. In other embodiments, the single strap may be configured to abut the bottom surface of the sole structure 200 and extend along the width of the sole structure 200 between the lateral and medial sides thereof.

In embodiments where the lateral and medial support straps 110, 112 are a single strap having an intermediate portion 113 and the single strap is configured to be adjustably and/or detachably coupled to the athletic cleat 100, the athletic cleat may be lasted without addition of the straps 110, 112. Following lasting of the athletic cleat 100, an outer bottom surface of a lasting board 115 may be altered (e.g., cut, shaved) to include a slot for the intermediate portion 113 of the single strap to pass through. In other embodiments, a barrier may be applied to the surface of the lasting board 115 where the single strap is intended to be positioned relative to the lasting board 115 to prevent the single strap from being adhered to the lasting board 115. As such, the intermediate portion 113 of the single support strap may pass through the slot in the lasting board 115 while the sole structure 200 is applied to the upper 102 via an adhesive. In this manner, the lasting board 115 may prevent the adhesive from adhering the single support strap to the sole structure 200 and/or upper 102. As such, the single support strap may be adjustably and/or detachably coupled to the athletic cleat 100 via the slot in the lasting board. By providing a single support strap, as described herein, that is positioned between the top surface of the sole structure 200 and bottom surface of the lasting board 115, said strap when tightened via a user tightening the shoelaces 106, in a manner generally the same as described above, may cause the portion of the strap location beneath the user's foot to tighten thereby resulting in a tight fit with the user's foot.

Referring back to FIGS. 1A-1B, in some embodiments, the lateral and medial support straps 110, 112 are positioned above where the ball of the user's foot meets the user's toes. In some embodiments, the lateral and medial support straps 110, and 112 are configured to provide lateral and medial support to the user's foot without causing the user's toes to be adducted by the lateral and medial support straps 110, and 112. In some embodiments, the lateral and medial support straps 110, and 112 are comprised of a material that is more rigid and/or has a greater firmness than the upper 102. In other embodiments, the lateral and medial support straps 110, and 112 are comprised of the same material as the upper 102. In some embodiments, the lateral and medial support straps 110 and 112 are comprised of a leather material, a faux leather material, a flexible plastic material, a fabric material, a polymer or a combination thereof.

In some embodiments, the upper 102 is comprised of a non-elastic material such that the surface area of the upper 102 generally does not expand over time as the athletic cleat 100 is repeatedly used by a user (e.g., as the athletic cleat 100 is "broken in"). In some embodiments, the upper is comprised of a bonded leather. In some embodiments, the athletic cleat 100 may conform to any common shoe sizing system such as the United States shoe sizing system, the United Kingdom shoe sizing system, or any other shoe sizing system used throughout the world. For example, the athletic cleat 100 may be a shoe size of U.S. men's size 11, for a user whose foot size closest matches a U.S. men's size 11. In other embodiments, the athletic cleat 100, including the upper 102 and the sole structure 200, are custom sized to best match the foot size of the user.

The upper 102 may be coupled to the sole structure 200 such that, in use, the upper 102 covers the top of a user's foot while the bottom of the user's foot is received within sole structure 200. The sole structure 200 may include a heel section 204, a midfoot section 206, and a forefoot section 208 sized to correspond to the heel, midfoot, and forefoot of the user's foot. The heel section 204, midfoot section 206, and forefoot section 208 may be integrally formed. The sole structure 200 may include a plurality of protrusions or studs 210 extending downwardly from the sole structure 200. The plurality of studs 210 may provide traction when the athletic cleat 100 is in use on soft or slippery surfaces (e.g., grass, synthetic turf). In some embodiments, there may be a shoe insole positioned within the athletic cleat 100 and coupled to the sole structure 200.

Figure 2:
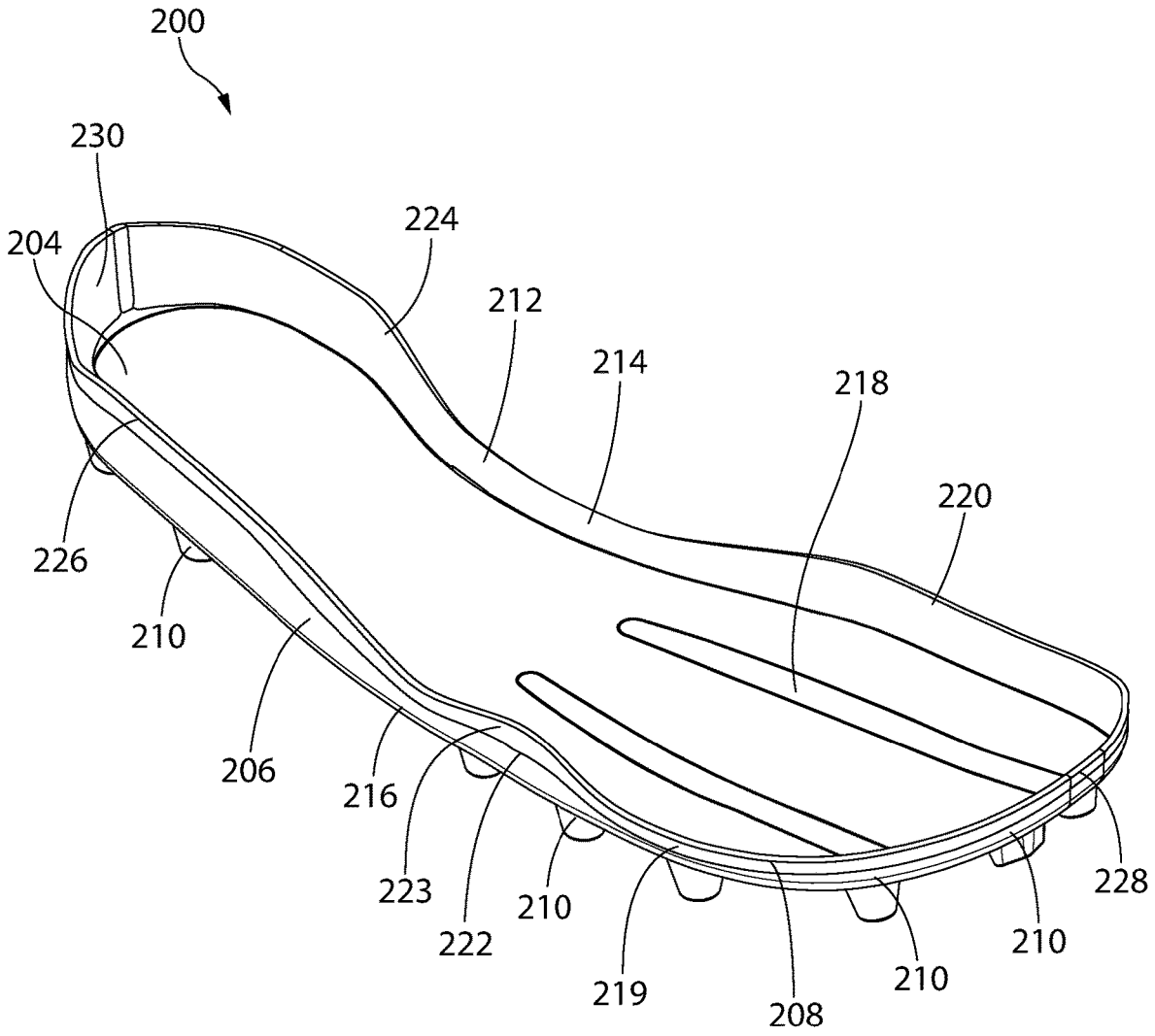
FIG. 2 is a left perspective view of the sole structure of the athletic cleat of FIG. 1A.
Figure 3:
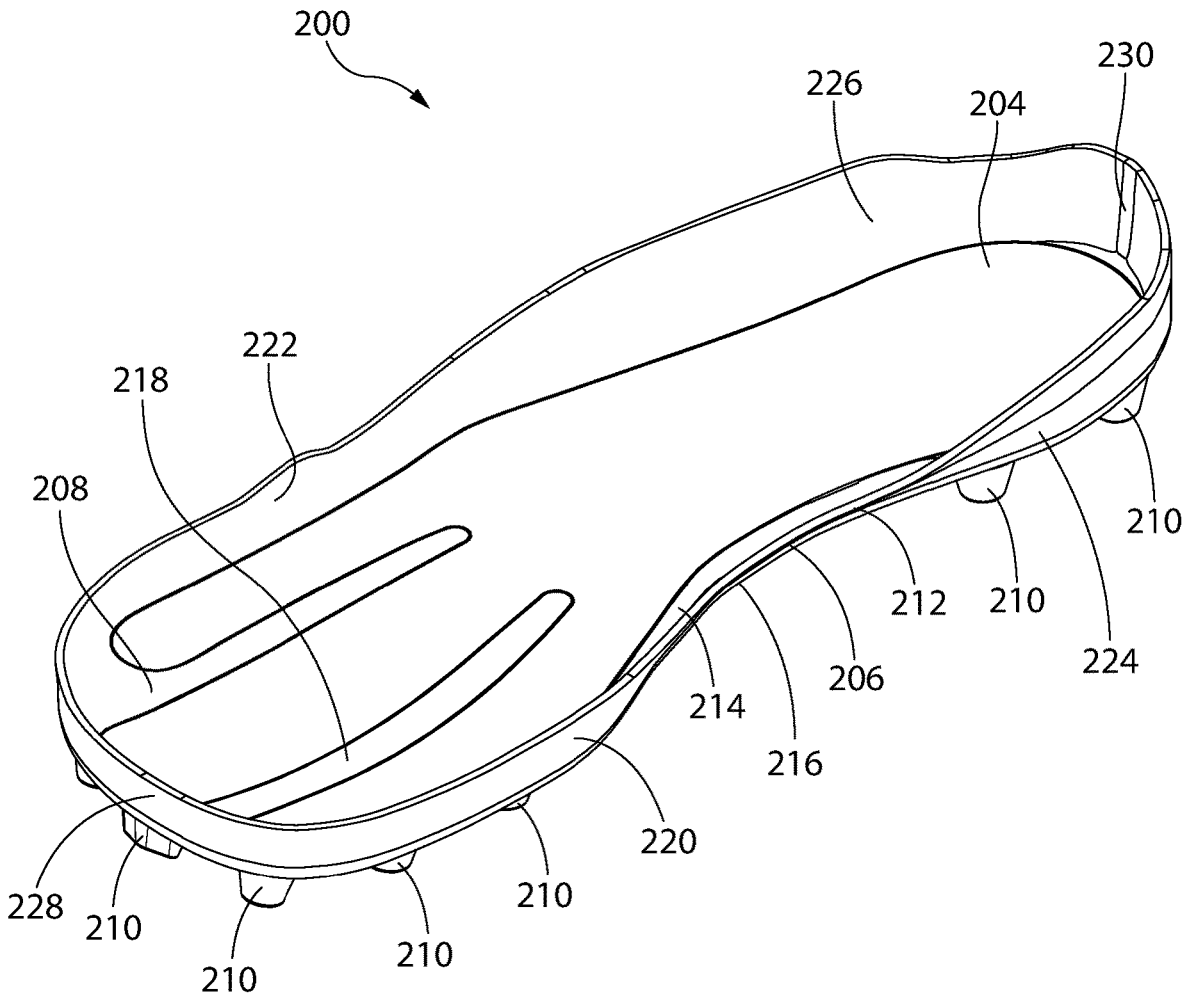
FIG. 3 is a right perspective view of the sole structure of the athletic cleat of FIG. 1A.

Referring to FIGS. 2-3, the sole structure 200 may include a base 212 extending along the heel section 204, midfoot section 206, and forefoot section 208. The base 212 may have a top surface 214 and a bottom surface 216 opposed from the top surface 214. The plurality of studs 210 may be coupled to and extend downwardly from the bottom surface 216 of the base 212. The forefoot section 208 may include a toe box 218 configured to be positioned below the user's toes when the athletic cleat 100 is worn by the user. The toe box 218 may be a wide toe box sized to allow the user's foot to lie naturally in the athletic cleat 100. The toe box 218 may be configured to accommodate the natural shape of the user's toes without compressing the user's toes. For example, the toe box 218 may be sized to prevent compression of user's toes such that the fourth and fifth phalanges and metatarsals are not adducted and/or such that the great and second phalanges and metatarsals are not adducted. Put another way, the toe box 218 may prevent compression of the user's toes such that, for example, the proximal phalanx of the user's great toe is colinear with the first metatarsal bone. Similarly, the proximal phalanx of the remaining toes may be generally colinear with the corresponding metatarsal bone. In this manner, the toe box 218 of the present disclosure may improve over the toe boxes of existing athletic footwear (e.g., cleated footwear), whether marketed as "wide toe box" or not, by allowing for the user's toes to be optimally positioned without adduction. The toe box 218 may be sized such that a distal end of a user's great toe is spaced from a distal end of the toe box, as discussed in more detail with reference to FIG. 5.

The sole structure 200 may include a support wall 219 extending at least partially around an outer periphery of sole structure 200 and configured to increase the lateral stability of the user. Increases in lateral stability may be beneficial during at least frontal plane movements performed by the user wearing the athletic cleat 100. In some embodiments, the support wall 219 is coupled to the base 212 and extends partially around a periphery at the top edge of the base 212. In some embodiments, support wall 219 extends around the entire outer periphery of sole structure 200 except for the medial side of the midfoot section 206. In some embodiments the support wall 219 includes a plurality of support sections configured to prevent a user's foot from extending past an outer periphery of the sole structure 200 during lateral movements (e.g., movements that are dominant within the frontal plane). The support wall 219 of sole structure 200 may include a first medial support section 220 coupled to the medial side of forefoot section 208 and extending upwardly from the top surface 214 of the base 212. In some embodiments, the first medial support section 220 is configured to extend substantially along a length of a first metatarsal of the user's foot when the athletic cleat 100 is worn by the user. For example, the first medial support section 220 may extend along outer periphery of the base 212 along a length generally equal to the length of the first metatarsal of the user.

The support wall 219 of sole structure 200 may include a first lateral support section 222 coupled to lateral side the forefoot section 208 of the base 212 on a side of the base 212 opposite the first medial support section 220. The first lateral support section 222 may extend upwardly from the top surface 214 of the base 212. In some embodiments, the first medial support section 220 and first lateral support section 222 extend upwardly from the top surface 214 of the base 212 substantially the same vertical distance. In other embodiments, the first medial support section 220 and first lateral support section 222 extend upwardly from the top surface 214 of base 212 an unequal vertical distance. In some embodiments, the toe box 218 is positioned forward of the first medial support section 220 and first lateral support section 222. In some embodiments, support wall 219 includes a vertical section 228 extending around a periphery of the toe box 218 from the first medial support section 220 to the first lateral support section 222. In some embodiments, the vertical section 228 is integrally formed with the first medial support section 220 and first lateral support section 222.

In some embodiments, the first lateral support section 222 includes a raised portion 223 configured to retain the user's foot within the support wall 219 and/or decrease energy loss when the user performs lateral movements. In some embodiments, the raised portion 223 may extend upwardly from the top surface 214 of the base 212. The raised portion 223 may be positioned along the first lateral support section 222 such that portion 223 is positioned proximate the joint of the user's fifth metatarsal. In some embodiments, the raised portion 223 extends upwardly from the top surface 214 of the base 212 to approximately where the joint of the user's fifth metatarsal is when the user is wearing the athletic cleat 100. In some embodiments, by providing the raised portion 223 proximate the joint of the user's fifth metatarsal, the lateral stability provided to the user during lateral movements may be increased when compared to conventional athletic cleats. In some embodiments, the raised portion 223 may have a generally convex curvature, as illustrated in FIGS. 2-7. However, the raised portion may be another shape such as, for example, but not limited to, generally square, generally rectangular, semi-circular, or semi-ovular.

The support wall 219 of sole structure 200 may include a second medial support section 224 coupled to the top surface 214 of the base 212. The second medial support section 224 may extend upwardly from the medial side of heel section 204 of the base 212. The support wall 219 of sole structure 200 may include a second lateral support section 226 coupled to the top surface 214 of the base 212. The second lateral support section 226 may be positioned along the lateral side of the heel section 204 and/or midfoot section 206 of the base 212 opposite the second medial support section 224. The second lateral support section 226 may extend upwardly from the heel section 204 of the base 212. In some embodiments, the second medial support section 224 and second lateral support section 226 extend upwardly from the top surface 214 of the base 212 by a generally unequal distance. In other embodiments, the second medial support section 224 and second lateral support section 226 extend upwardly from the top surface 214 of the base 212 substantially the same vertical distance.

In some embodiments, the first medial support section 220, first lateral support section 222, second medial support section 224, and second lateral support section 226 are integrally formed with the base 212. In some embodiments, the support wall 219 of the sole structure 200 includes a second vertical section 230 extending around a periphery of the heel section 204. In some embodiments, the second vertical section 230 extends from the second medial support section 224 to the second lateral support section 226. In some embodiments, the second vertical section 230 is integrally formed with the second medial support section 224 and second lateral support section 226. In some embodiments, the second vertical section 230, second medial support section 224 and second lateral support section 226 are integrally formed with the base 212. In some embodiments, by providing support sections 220, 222, 224, and 226 in support wall 219, the ability of a user wearing athletic cleat 100 to make abrupt lateral movements may be increased while decreasing the heel elevation of the user.

In some embodiments, the first medial support section 220, first lateral support section 222, second medial support section 224, second lateral support section 226, vertical section 228 and second vertical section 230 may be integrally formed with the base 212. In some embodiments, the first medial support section 220, first lateral support section 222, second medial support section 224, second lateral support section 226, vertical section 228 and second vertical section 230 are comprised of the same material. In some embodiments, one or more of the first medial support section 220, first lateral support section 222, second medial support section 224, second lateral support section 226, vertical section 228 and second vertical section 230 may be comprised of a material configured to be used with conventional three-dimensional printing systems and methods. In some embodiments, the first medial support section 220, first lateral support section 222, second medial support section 224, second lateral support section 226, vertical section 228 and second vertical section 230 may be comprised of a hardened elastomer used in urethane casting having a shore hardness greater than 90. In some embodiments, the first medial support section 220, first lateral support section 222, second medial support section 224, second lateral support section 226, vertical section 228 and second vertical section 230 are comprised of a material configured to be used with conventional injection molding systems and methods.

Figure 4:
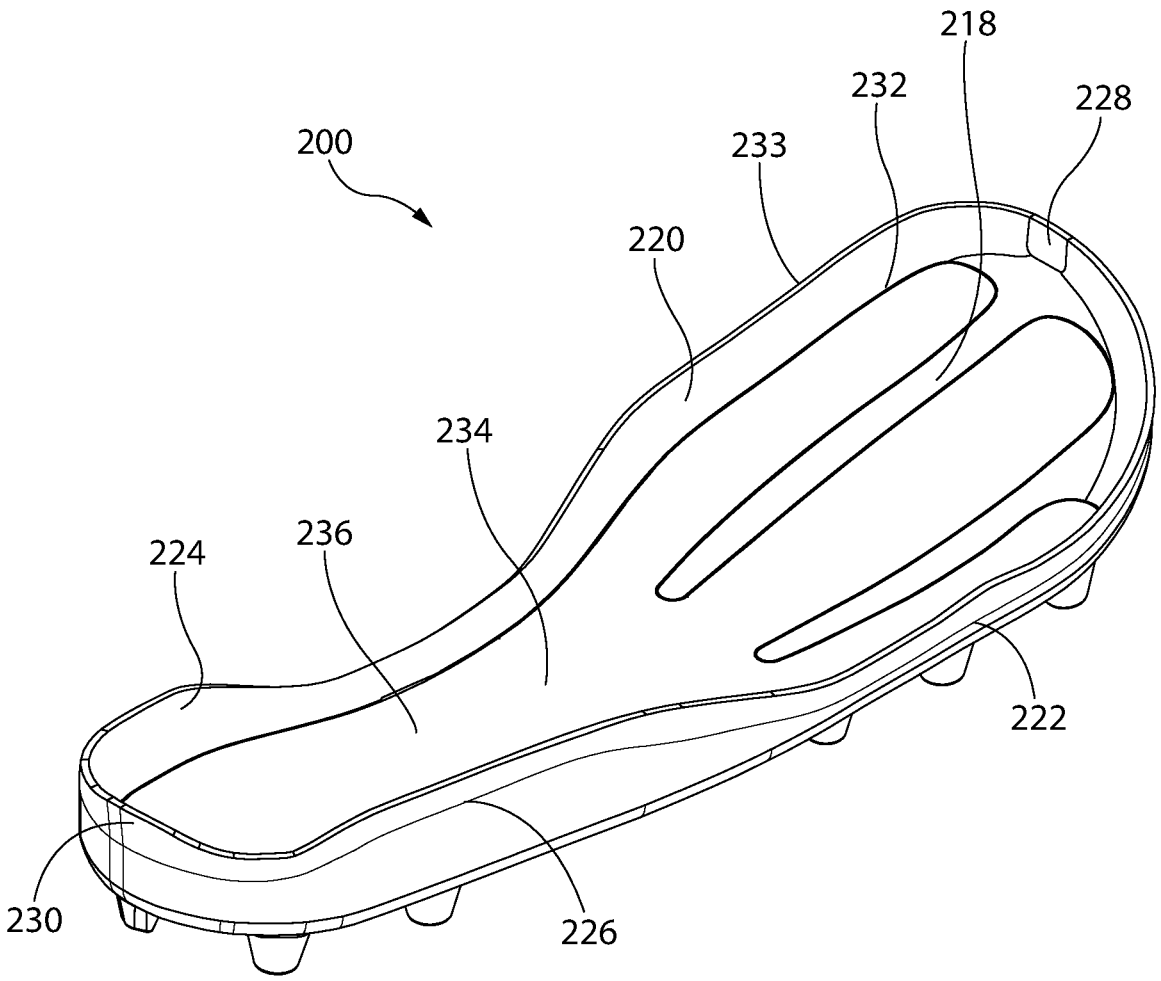
FIG. 4 is a rear perspective view of the sole structure of the athletic cleat of FIG. 1A.
Figure 5:
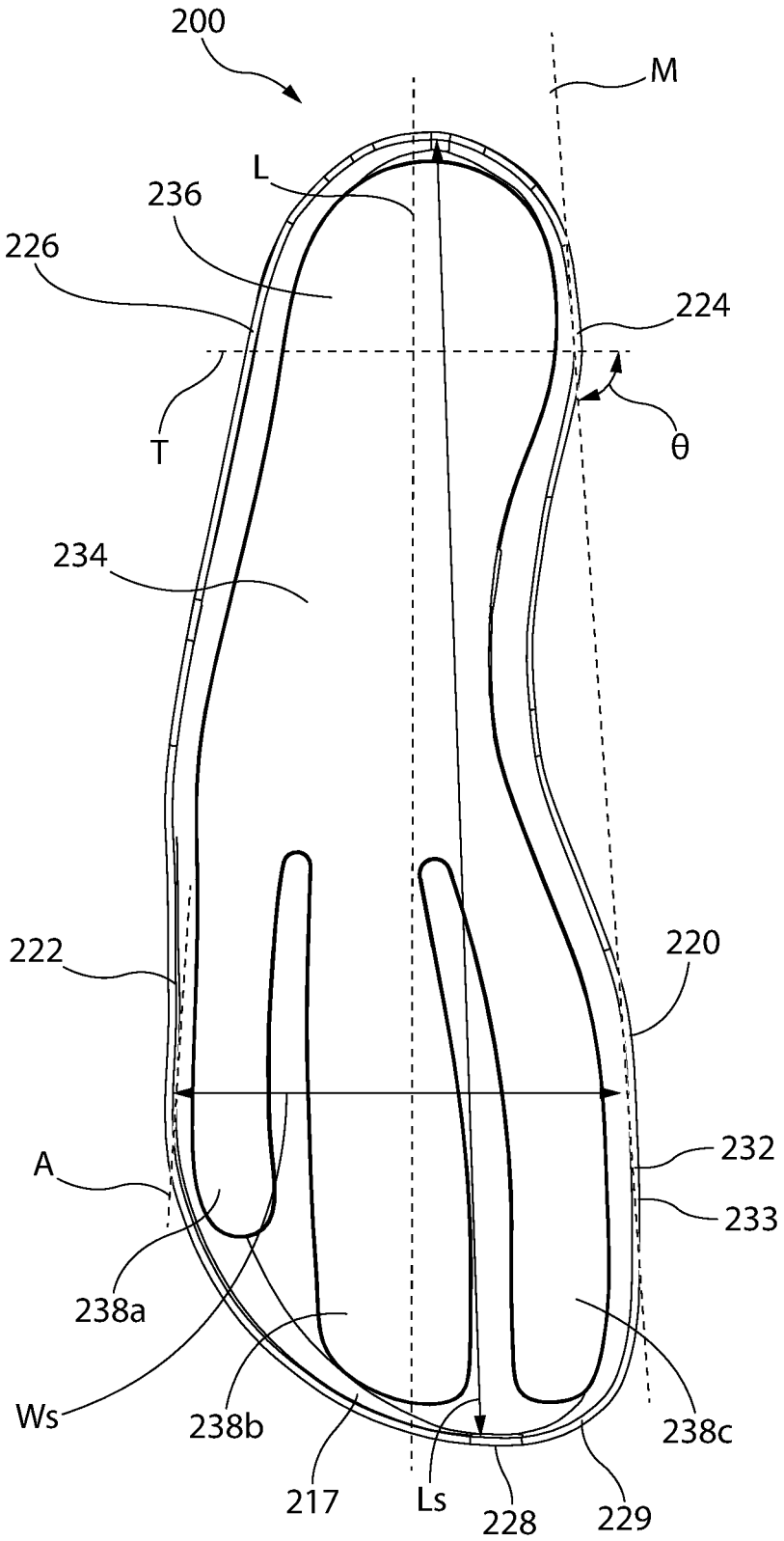
FIG. 5 is a top plan view of the sole structure of the athletic cleat of FIG. 1A.

Referring to FIGS. 4-5, the toe box 218 may include a medial inner side edge 232 aligned with a medial axis M. The medial axis M may be an imaginary line which extends along the medial inner side edge 232 and is tangent to the heel section 204. In some embodiments, the medial axis M extends along the medial inner side edge 232 and is tangent to an inner side edge of the heel section 204. In some embodiments, the first medial support section 220 is aligned with the medial axis M. In some embodiments, the medial axis M extends along the medial inner side edge 232 of the first medial support section 220 and is tangent to a section of the second medial support section 224. The medial inner side edge 232 may be configured to extend substantially along a total length of the user's great toe. For example, the medial inner side edge 232 extends along the periphery of the toe box 218 a length generally equal to the length of the proximal and distal phalanx of a user's great toe.

In some embodiments, the medial inner side edge 232, aligned with the medial axis M, may extend substantially along a distance which is greater than or equal to the length of a proximal phalanx of the user's great toe but less than the total length of the user's great toe. In some embodiments, the medial axis M is at an acute angle θ relative to a transverse axis T. It should be understood that the transverse axis T of the sole structure 200 is separate and distinct from a transverse plane in which the user may move and/or transverse movements the user makes while wearing the athletic cleat 100. The transverse plane will be understood as one of the three planes of motion of the body that is distinct from the frontal and sagittal plane. In some embodiments, by providing a medial inner side edge 232 extending along generally the length of the user's great toe and aligned with the medial axis M, the toe box 218 may be configured to receive the user's toes without compressing the great toe and second phalange. For example, the medial inner side edge 232 being aligned with the medial axis M may prevent the adduction of the user's toes and allow the proximal phalanx of each toe to be generally colinear with a corresponding metatarsal bone, as discussed above. In this manner, power production through the user's foot and lower leg may be optimized while reducing the risk of common toe, foot, and/or ankle injuries. In some embodiments, by providing the medial inner side edge 232 extending along generally the length of the user's great toe and aligned with the medial axis M, the longitudinal power production of a user wearing athletic cleat 100 may be increased while decreasing the risk of injuries occurring.

In some embodiments, toe box 218 is sized such that the distal end of the user's great toe is spaced from a portion of the vertical section 228 directly forward of the distal end of the user's great toe by a predetermined distance. The distance between the distal end of the user's great toe and portion of the vertical section 228 may be measured along an axis generally aligned with the proximal and distal phalanx of the user's great toe, extending from the distal end of the user's great toe to where said axis intersects vertical section 228. For example, the vertical section 228, which extends around the outer periphery of toe box 218, extends from the first medial support section 220 along medial inner side edge 232 tapers from the medial inner side edge 232 toward a front portion 217 of toe box 218 and extends from the front portion of toe box 218 to the first lateral support section 222. The portion 229 of vertical section 228 proximate where the vertical section 228 tapers from the medial inner side edge 232 toward the front portion 217 may be proximate a user's great toe when in use. The toe box 218 may be sized such that portion 229 of vertical section 228, which extends around the outer periphery of toe box 218, is spaced from a distal end of the user's great toe by about 12.70 mm. In some embodiments, the toe box 218 is sized such that portion 229 of vertical section 228 is spaced from a distal end of the user's great toe by a distance in a range of about 6.35 mm to about 19.05 mm. In some embodiments, the toe box 218 is sized such that portion 229 of vertical section 228 is spaced from a distal end of the user's great toe by a distance in a range of about 8.90 mm to about 16.50 mm. In some embodiments, the toe box 218 is sized such that portion 229 of vertical section 228 is spaced from a distal end of the user's great toe by a distance of at least 12.70 mm.

The sole structure 200 may include a medial outer side edge 233 disposed opposite the medial inner side edge 232. In some embodiments, the medial outer side edge 233 is generally parallel to the medial inner side edge 232. In other embodiments, the medial outer side edge 233 may be convex. In some embodiments, the widest portion of the toe box 218 may extend from the medial inner side edge 232 to the opposite side of the toe box 218 which is configured to receive the user's fifth phalange. In some embodiments, the widest portion of the toe box 218 may have a width W. In some embodiments, the width $W_S$ of toe box 218 may be dependent upon the overall length $L_S$ of the sole structure 200. The overall length $L_S$ may be measured from the rearmost point in the heel section 204 to the portion of the vertical section 228 which would be proximal a user's second phalange (e.g., user's longest toe). In some embodiments, the width $W_S$ to length $L_S$ ratio may be about 2.70.

In some embodiments, a portion of the vertical section 228 extends upwardly from the medial inner side edge 232 such that said portion is aligned with the medial axis M. For example, the portion of the vertical section 228 which extends along the medial inner side edge 232 of the toe box 218 extends vertically upward from the toe box 218. In some embodiments the first medial support section 220 extends rearwardly from the medial inner side edge 232 of the toe box 218. In some embodiments, the first medial support section 220 is generally aligned with the medial axis M. In some embodiments, the first lateral support section 222 may extend rearwardly from the toe box 218 and has a concave curvature. For example, a portion of the first lateral support section 222 may extend in a direction generally aligned with the axis A and another portion extending at an acute angle relative to axis A. By providing a portion of the first lateral support section 222 generally aligned with axis A, the risk of lateral ankle sprains during use of the sole structure may be reduced.

In some embodiments, there is an inflection point where the first lateral support section 222 couples to the vertical section 228 surrounding the outer periphery of the toe box 218. In some embodiments, by providing an inflection point where the first lateral support section 222 meets the vertical section 228, the toe box 218 may be sized such that the user's fifth phalange is not compressed by the vertical section 228. In other embodiments, there is no inflection point where the first lateral support section 222 couples to the vertical section 228 such that the first lateral support section 222 extends along a generally linear axis. In some embodiments, the first lateral support section 222 and second lateral support section 226 extend along generally the same axis. In some embodiments, the portion of the first lateral support section 222 which extends generally aligned with axis A may prevent the user's fourth and fifth phalanges from being adducted. When the user's fourth and fifth phalange are not adducted, intrinsic musculature of the user's foot may be capable of activating, the lateral stability of the user's foot may be increased, and may reduce the occurrence of lateral ankle sprains.

In some embodiments, the sole structure 200 may be configured to receive a reinforcement member 234 configured to provide additional stability, rigidity, and/or energy return to a user wearing the athletic shoe 100. In some embodiments, the reinforcement member 234 is coupled to the top surface 214 of the base 212 and extends along the heel section 204, midfoot section 206, and forefoot section 208. The top surface 214 of the base 212 may include a recessed area (e.g., recessed area 235 shown in FIG. 11) configured to receive the reinforcement member 234. In some embodiments, the recessed area extends into the thickness of the base 212 a distance generally equal to the thickness of the reinforcement member 234 such that the top surface of the reinforcement member 234 is flush with the top surface 214 of the base 212. In other embodiments, the recessed area extends into the thickness of the base 212 at a distance unequal to the thickness of the reinforcement member such that the reinforcement member 234 partially extends above the top surface 214 or the reinforcement member 234 is recessed below the top surface 214. In some embodiments the reinforcement member 234 may be comprised of a generally rigid material. In some embodiments, the reinforcement member 234 is comprised of a material which is more rigid than the material comprising the sole structure 200. Put another way, the reinforcement member 234 may have a greater modulus of rigidity than the sole structure 200. Put yet another way, the sole structure 200 may have a greater modulus of elasticity than the reinforcement member 234. In some embodiments, the reinforcement member 234 may be comprised of: steel, aluminum, semi-crystalline polymers, amorphous polymers, metal alloys, composite materials, aramid, carbon fiber, fiberglass, acrylonitrile butadiene styrene (ABS), polyethylene vinyl acetate (PEVA) or a combination thereof.

In some embodiments, the reinforcement member 234 includes a first section 236 extending along the heel section 204 and midfoot section 206. In some embodiments, the first section 236, when coupled to the base 212, may be configured to provide support to the base 212 such that bending about a longitudinal axis L and/or a transverse axis T is resisted. In some embodiments the first section 236 is configured to resist bending along at least the transverse axis T extending between the second medial support section 224 and the second lateral support section 226. The first section 236 of the reinforcement member resists bending along the transverse axis T and the longitudinal axis L, or, put another way, along and perpendicular to the transverse axis T. In some embodiments, the first section 236 is configured to resist bending about the longitudinal axis L and/or transverse axis T which occurs in the heel section 204 and midfoot section 206 of the base 212. In some embodiments, the first section 236 may prevent the base 212 from bending along the transverse axis T. In some embodiments, the reinforcement member 234 includes a plurality of members 238*a*-238*c* coupled to and extending from the first section 236 to the forefoot section 208. In some embodiments, the first section 236 and the plurality of members 238*a*-238*c* are integrally formed. The plurality of members 238*a*-238*c*, may be configured to resist bending in a direction along or parallel to the longitudinal axis L while allowing bending in a direction parallel to the transverse axis T. For example, the plurality of members 238*a*-238*c* may each be a uniform construct extending at least partially along the length of the forefoot section 208 and spaced from one another in a direction parallel to the transverse axis T. In some embodiments, the plurality of members 238*a*-238*c* may prevent the forefoot section 208 of the base 212 from bending in a direction along or parallel to the longitudinal axis T, when the reinforcement member 234 is coupled to the base 212. In the embodiment shown in FIG. 5, the plurality of members 238*a*-238*c* includes three members, however the plurality of members may include two members, three, four members, or more than four members.

Figure 6:
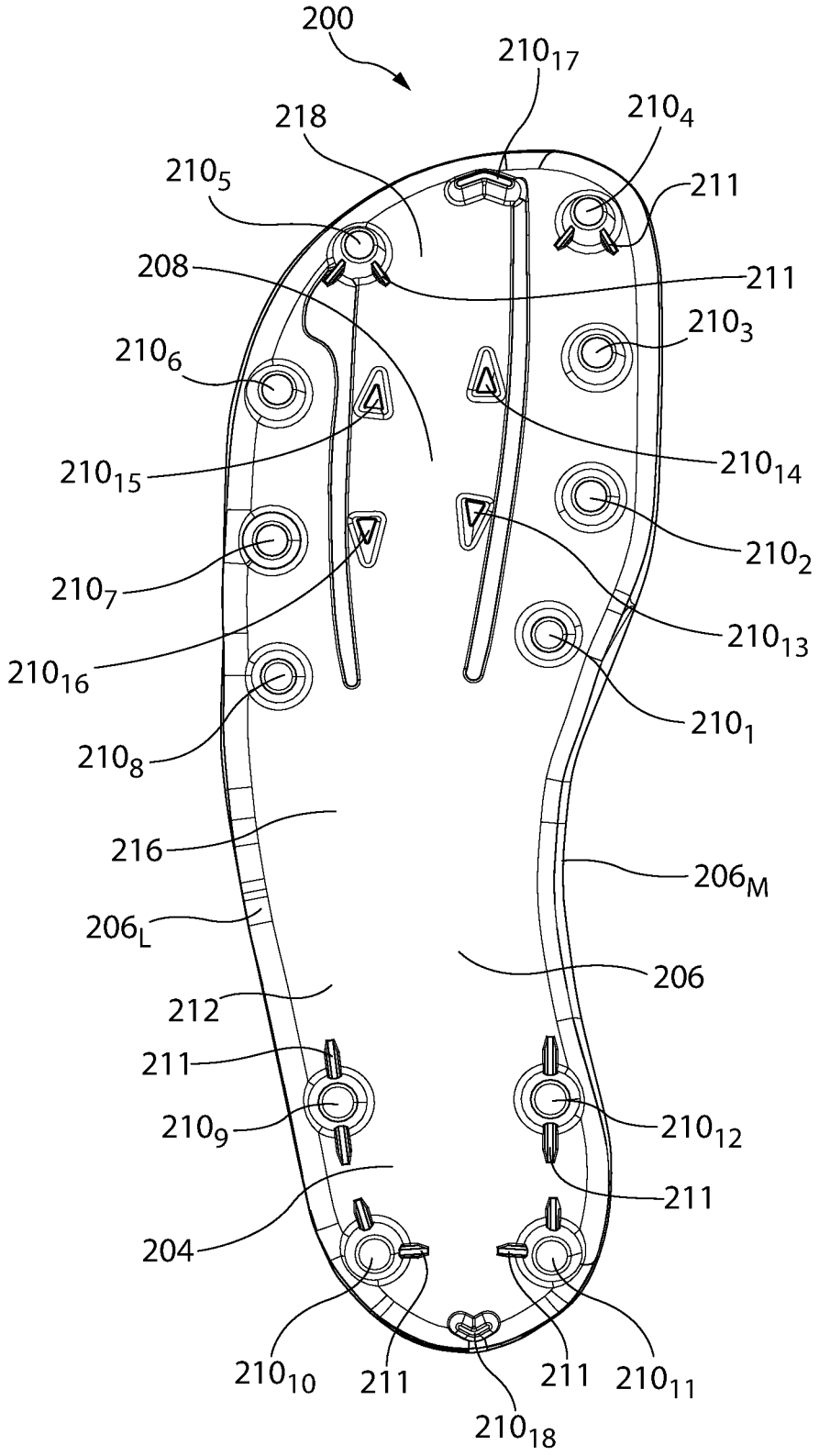
FIG. 6 is a bottom plan view of the sole structure of the athletic cleat of FIG. 1A.

Referring to FIG. 6, the sole structure 200 may include studs 210 coupled to the bottom surface 216 of the base 212. The studs 210 may include a plurality of studs $210_1$-$210_{18}$ coupled to the bottom surface 216 of the base 212. In some embodiments, the one or more studs 210 may be coupled to the forefoot section 208 and heel section 204 of the base 212. For example, studs $210_1$-$210_8$, $210_{13}$-$210_{16}$, and $210_{17}$ may be coupled to the forefoot section 208 of the base 212. In some embodiments, one or more studs 210 may be coupled to the heel section 204 of the base 212. For example, studs $210_9$-$210_{12}$, and $210_{18}$ may be coupled to the heel section 204. In some embodiments, one or more studs proximal the toe box 218 of the forefoot section may be aligned with an outer periphery of the reinforcement member 234. For example, studs $210_3$, $210_4$, $210_5$, and $210_6$ may be aligned with and below an outer periphery of members 238*a* and 238*c* of the reinforcement member 234.

In some embodiments, one or more of studs 210 have a generally frustoconical shape. For example, studs $210_1$-$210_{12}$ have a generally frustoconical shape wherein the base of each of the studs which couples to the bottom surface 216 of the base 212 has a larger diameter than the terminus of each of said studs. In some embodiments, one or more of the studs 210 may be a different shape other than frustoconical. For example, studs $210_{13}$-$210_{16}$ have generally triangular shape, and $210_{17}$-$210_{18}$ have a bent shape when viewed from the bottom of the sole structure 200. In some embodiments, studs $210_1$-$210_{12}$ may protrude from the bottom surface 216 by a greater distance than studs $210_{13}$-$210_{18}$. In this manner, the studs $210_1$-$210_{12}$ may penetrate further into a playing surface (e.g., ground) than the studs $210_{13}$-$210_{18}$ to provide mobility during transverse movements. Furthermore, the studs $210_{12}$-$210_{18}$ may have a geometry that is different from studs $210_1$-$210_{12}$ thereby improving traction when the pressure applied to the areas of the sole structure 200 where the studs $210_{12}$-$210_{18}$ are located is increased (e.g., during toe off or heal strike movements). In some embodiments, by providing frustoconical shaped studs $210_1$-$210_{12}$ the mobility of a user wearing athletic cleat 100 may be increased along a transverse plane (e.g., during twisting movements within transverse plane).

Figure 11:
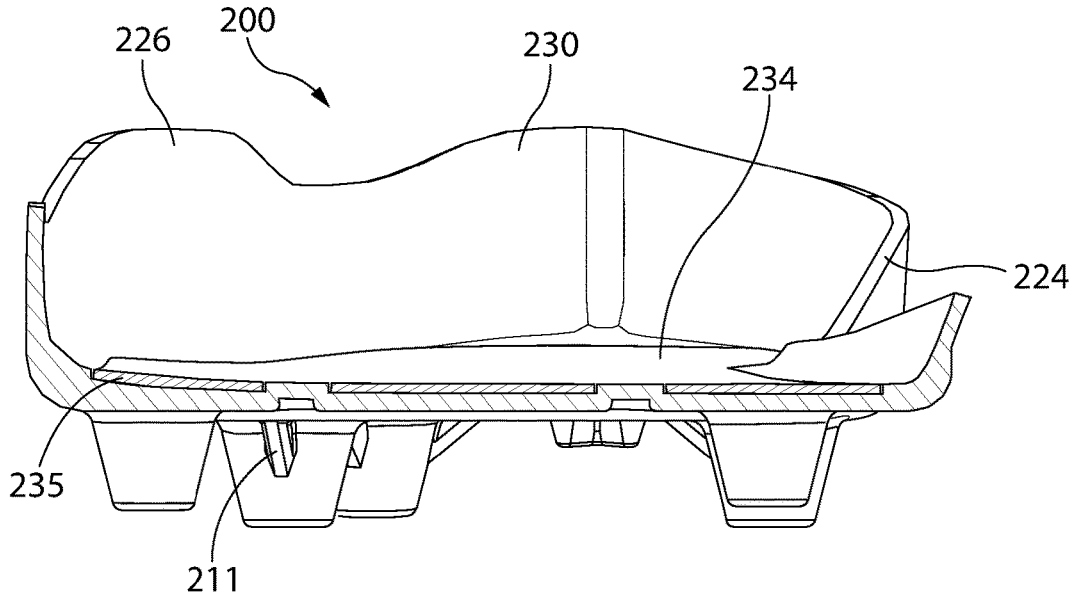
FIG. 11 is a front elevational cross-sectional view of the sole structure of the athletic cleat of FIG. 1A.

Referring to FIGS. 6 and 11, in some embodiments, one or more of the studs 210 may include a blade like protrusion 211, generally referred to as blade 211, coupled thereto. In some embodiments, each blade 211 may extend from the bottom surface 216 of the base 212 to a corresponding stud 210. In some embodiments, each of the blades 211 is integrally formed with the base 212 and a corresponding stud 210. In some embodiments, fewer than all of the studs 210 include blades 211. For example, the blades 211 may be coupled to, or included with, one or more of the frustoconical shaped studs $210_1$-$210_{12}$. In some embodiments, the blades 211 are coupled to a subset of the frustoconical shaped studs $210_1$-$210_{12}$ where rotation of the user's foot proximal those studs $210_1$-$210_{12}$ is not desired. For example, the blades 211 may be coupled to studs $210_4$, $210_5$ and $210_9$-$210_{12}$. These studs $210_4$, $210_5$ and $210_9$-$210_{12}$ may correspond to the distal end of the user's forefoot and the user's heel. In some embodiments, there are two or more blades 211 coupled to each of the studs $210_4$, $210_5$ and $210_9$-$210_{12}$.

The blades 211 may extend at an angle relative to the bottom surface 216 of the base 212 to a corresponding stud 210 between the bottom surface 216 of the base and a bottom surface of the stud 210. Put another way, the blades 211 may not extend entirely along the height of a corresponding stud 210 or, put yet another way, the blades 211 may not extend to the bottom surface of the studs 210. In this manner, the blades 211 may be configured to provide traction by penetrating, or at least directly contacting, a playing surface when the user applies an amount of pressure that is focused in an area of the sole structure 200 proximate one or more of the studs 210. In some embodiments, one or more of the studs 210 may penetrate a playing surface while the blades 211 coupled thereto may not when pressure applied to the sole structure 200 is less than a predetermined amount or, put another way, when the pressure applied to the sole structure 200 is not focused in an area where one or more of the blades 211 is located. The predetermined amount of pressure may be generally equal to or less than an amount of pressure applied by the user when said amount of pressure is significantly higher (e.g., focused) in one area of the sole structure 200 than another. For example, during sagittal plane decelerations performed by the user, pressure applied by the user may be focused at the heel section 204 of the sole structure 200 thereby causing the blades 211 coupled to studs $210_{10}$ and $210_{11}$ to penetrate a playing surface whereas the blades 211 coupled to the studs $210_5$ and $210_4$ at the forefoot section 208 may not.

It will be understood that the predetermined amount of pressure required to cause one or more of the blades 211 to penetrate a playing surface is dependent upon the properties of the playing surface. For example, a lesser amount of pressure would be required to penetrate a wet or muddy playing surface when compared to a dry playing surface. Similarly, a softer playing surface would require less pressure to cause the blades 211 to penetrate said soft playing surface when compared to a generally harder playing surface.

In some embodiments, the orientation of each blade 211 relative to the base 212 may be dependent on the direction of a force the blade 211 is intended to resist. For example, each blade 211 may extend along an axis that is generally perpendicular to a direction of a force that the blade 211 is intended to resist. As such, one or more of the blades 211 may have an orientation relative to the base 212 that is different from one or more other blades 211. For example, one or more of the blades 211 coupled to stud $210_{12}$ have a different orientation than one or more of the blades 211 coupled to stud $210_4$ and/or stud $210_{11}$. In some embodiments, the blades 211 coupled to studs $210_9$ and $210_{12}$ are configured to resist sliding and/or rotation during primarily frontal plane movements of the user. For example, the orientation of each of the blades 211 coupled to studs $210_9$ and $210_{12}$ may be along axes that are perpendicular to the direction of forces associated with, or caused by, sliding and/or rotation during primarily frontal plane movements. In some embodiments, the blades 211 coupled to studs $210_{10}$-$210_{11}$ are configured to improve traction in both lateral and longitudinal, or frontal plane and sagittal plane, breaking forces. In some embodiments, the studs 210 proximate the ball of the user's foot may not include any blades 211. For example, studs $210_1$-$210_3$ and $210_6$-$210_8$ may not include blades 211.

In some embodiments, by providing blades 211 on one or more of the studs 210, the mobility of the user may be improved during one or more predetermined movements. For example, each of the blades 211 may be positioned and/or oriented relative to the base 212 to resist forces in directions associated with one or more predetermined movements thereby improving the user's mobility and control (e.g., prevent sliding and/or slipping) during said movements. For example, blades 211 positioned perpendicular to the direction of an applied force aid in resisting unwanted slipping in the direction of the applied force.

Referring to FIGS. 3 and 6, the second lateral support section 226 may extend upwardly from the base 212 along the lateral side of the heel section 204 and the lateral side $206_L$ of the midfoot section 206 such that when worn, the second lateral support section 226 is adjacent the lateral side of the heel and midfoot of a user's foot. In some embodiments, the midfoot section 206 may be sized and/or shaped such that the second lateral support section 226 of support wall 219 may extend upwardly from base 212 adjacent to the lateral side of a user's foot. For example, the midfoot section 206 includes a lateral side $206_L$ having a convex curvature and a medial side $206_M$ having a concave curvature. In some embodiments, by providing a lateral side $206_L$ having a convex curvature the lateral side $206_L$ may be positioned adjacent the lateral side of the midfoot of a user's foot as opposed to being positioned under the user's foot thereby allowing for the second lateral support section 226 to be included in sole structure 200.

Figure 14:
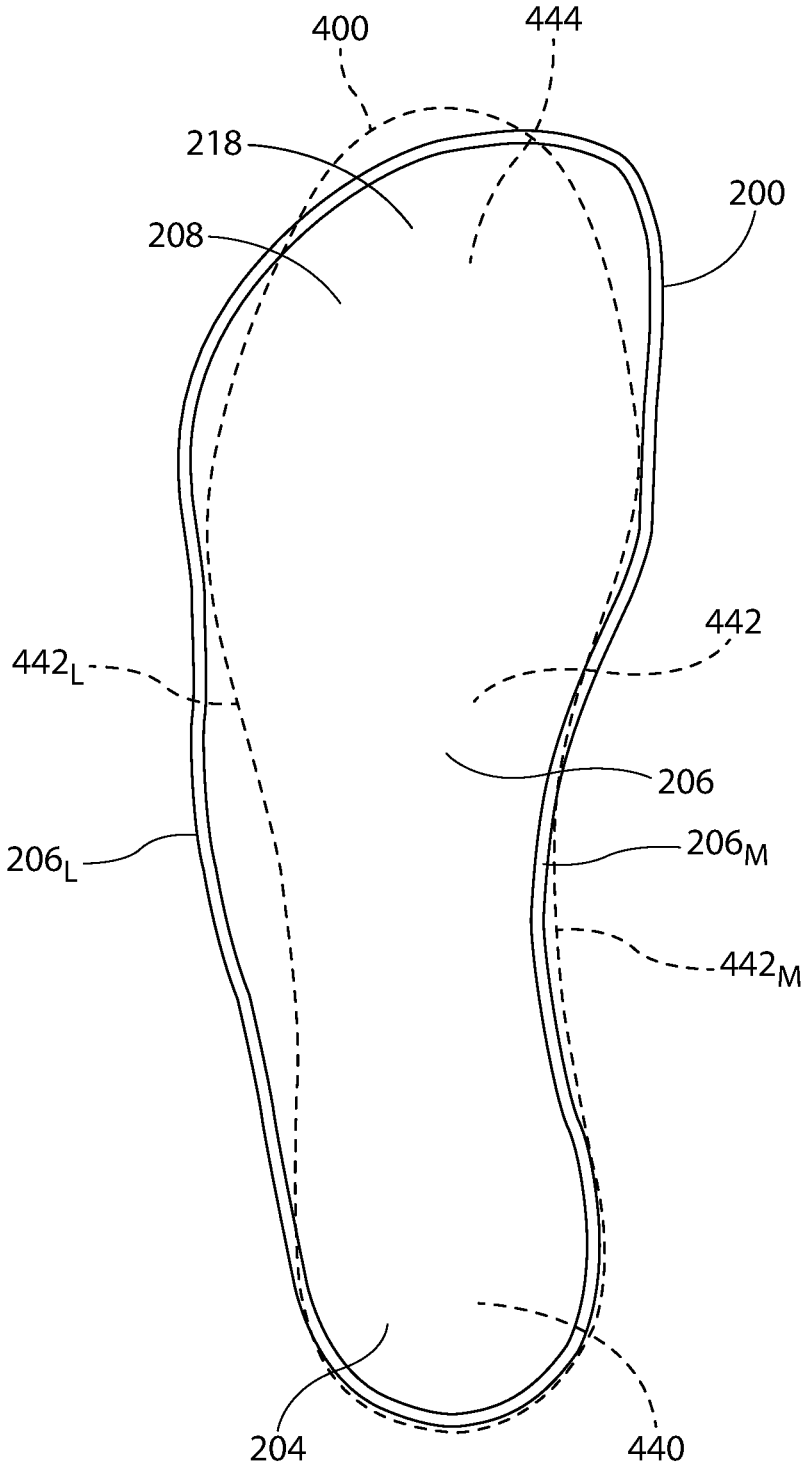
FIG. 14 is a bottom schematic view of the sole structure of the athletic cleat of FIG. 1A and a conventional sole structure.

For example, referring to FIG. 14, there is shown a bottom schematic view illustrating a comparison of the sole structure 200 of the present disclosure with a conventional sole structure 400 (illustrated in broken line). The conventional sole structure 400 may include a heel section 440, midfoot section 442, and forefoot section 444 generally proximate the heel section 204, midfoot section 206, and forefoot section 208 of sole structure 200 of the present disclosure. As can be seen in FIG. 14, the midfoot section 442 of conventional sole structure 400 includes a lateral side $442_L$ and a medial side $442_M$ that both have a concave curvature. Put another way, the lateral side $442_L$ and medial side $442_M$ are generally symmetrical to one another along a lateral centerline of the sole structure 400. Such a concave curvature of both the lateral and medial sides $442_L$ and $442_M$ may prevent the midfoot section of conventional sole structure 400 from receiving the entire midfoot portion of the bottom of a user's foot wearing the conventional sole structure 400. Additionally, the concave curvature of lateral side $442_L$ may prevent the conventional sole structure 400 from including an upwardly extending support wall because the lateral side $442_L$ would be disposed below the user's foot. Put another way, the concave curvature of the lateral side $442_L$ would cause a support wall that extends upwardly from the lateral side $442_L$ to be pressed into the user's foot which would lead to discomfort for the user and prevent the user's foot from resting on the bottom surface of the sole structure 400.

In this manner, the sole structure 200 of the present disclosure may offer improved lateral stability via support wall 219 that extends around substantially all of, or at least a majority of, the user's foot while conventional sole structures 400 prevent the inclusion of such a lateral support structure. For example, the lateral side $206_L$ of the midfoot section 206 of the sole structure 200 has a generally convex curvature. As such, the generally convex lateral side $206_L$ may allow the user's foot to be received on the top surface of the sole structure 200 while also allowing for the support wall 219 to extend upwardly from the convex lateral side $206_L$ without abutting the bottom of the user's foot. In some embodiments, the entire lateral side of the sole structure 200, including the lateral side $206_L$ and lateral sides of the heel section 204 and forefoot section 208, has a generally convex shape. For example, when viewed from a bottom elevational view (e.g., FIG. 14) or a top elevational view, the lateral side of the sole structure 200 has a generally convex curvature from the heel section 204 to the forefoot section 208 as opposed to the shape of the sole structure 400.

As illustrated, the conventional sole structure 400 has a convex curvature at the lateral sides of the heel section 440 and forefoot section 444, and a concave curvature along the entire midfoot section 442. It will be understood that even though the sole structure 200 may include a generally concave portion where the lateral side $206_L$ of the midfoot section 206 connects to the forefoot section 208, that the majority of the lateral side $206_L$ has a convex curvature and as such, the entire lateral side of the sole structure 200 may be considered to have a generally convex curvature. Put another way, the majority of the lateral side of the sole structure 200 has a convex curvature. In some embodiments, the shape of at least the toe box 218 of the sole structure 200 may also allow for the user's forefoot to be received thereon while allowing for the support wall 219 to extend upwardly therefrom without abutting the bottom of the user's foot.

Figure 7:
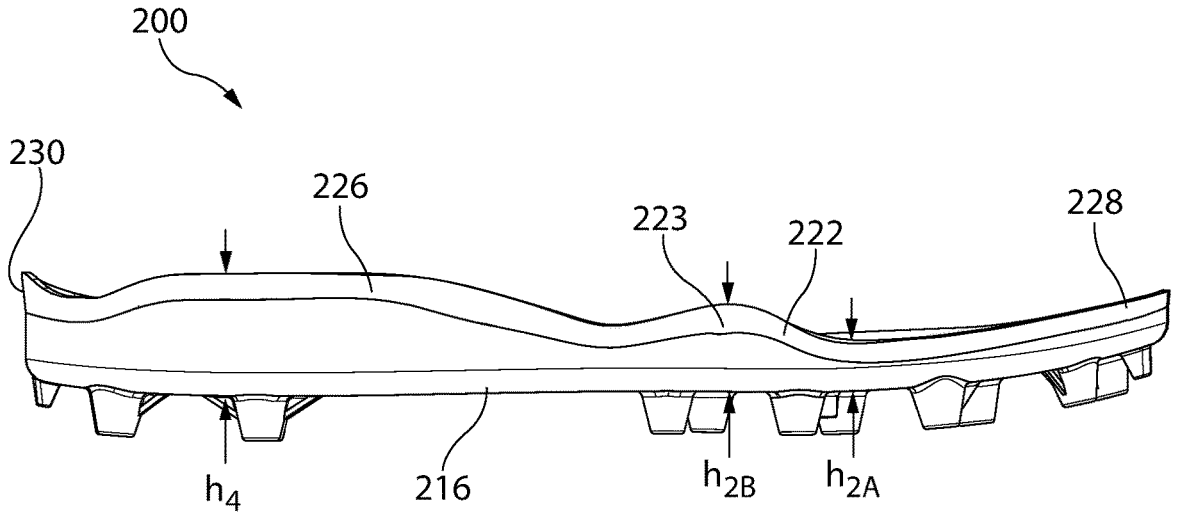
FIG. 7 is a right-side elevational view of the sole structure of the athletic cleat of FIG. 1A.
Figure 8:
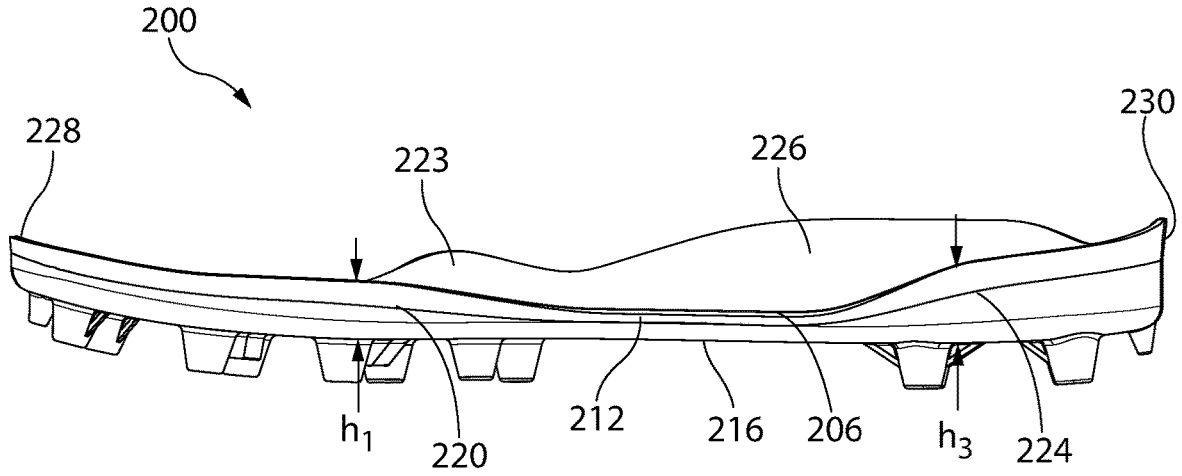
FIG. 8 is a left-side elevational view of the sole structure of the athletic cleat of FIG. 1A.

Referring to FIGS. 7-8, the support sections of support wall 219 may each extend upwardly from the base 212 at a predetermined height. In some embodiments, the height of each support section corresponds to the size of the sole structure 200. For example, if the sole structure 200 is sized to correspond to a first common shoe size (e.g., U.S. men's size 11) the height of each of said sections may be different from a sole structure sized to correspond to a second common shoe size (e.g., U.S. men's size 9). In some embodiments, the second lateral support section 226 has a height $h_4$ extending in a vertical direction from the bottom surface 216 of the base 212 to a top surface of the second lateral support section 226. The height $h_4$ may be within a range of about 20 mm to about 35 mm depending on the size of the sole structure 200. In some embodiments, the first lateral support section 222 may have a first height $h_{2A}$ extending in a vertical direction from the bottom surface 216 of the base 212 to a top surface of the first lateral support section 222 where the first lateral support section 222 connects to the first vertical section 228. The first height $h_2$ of the first lateral support section 222 may be within a range of about 10 mm to about 20 mm depending on the size of the sole structure 200.

The first lateral support section 222 may have a second height $h_{2B}$ which may correspond to the height of the raised portion 223 of the first lateral support section 222. The second height $h_{2B}$ may be measured in a vertical direction from the bottom surface 216 of the base 212 to a top surface of the raised portion 223. The second height $h_{2B}$ may be within a range of about 20.00 mm to about 25.00 mm depending on the size of the sole structure 200. In some embodiments, the height $h_4$ of the second lateral support section 226 is greater than or equal to the first height $h_{2A}$ and/or second height $h_{2B}$ of the first lateral support section 222. In other embodiments, the second height $h_{2B}$ may be generally equal to or greater than the height $h_4$ of the second lateral support section 226.

In some embodiments, the first medial support section 220 may have a height $h_1$ extending in a vertical direction from the bottom surface 216 of the base 212 to a top surface of the first medial support section 220. The height $h_1$ may be within a range of about 10 mm to about 20 mm depending on the size of the sole structure 200. In some embodiments, the second medial support section 224 may have a maximum height $h_3$ extending in a vertical direction from the bottom surface 216 of the base 212 to a top surface of the second medial support section 224. The maximum height $h_3$ may be within a range of about 15 mm to about 25 mm depending on the size of the sole structure 200. In some embodiments the height $h_3$ of the second medial support section 224 may be less than or equal to the height $h_1$ of the first medial support section 220. In some embodiments, the height $h_1$ and $h_3$ represent the maximum height of the corresponding first and second medial support sections 220, 224. For example, as shown in FIG. 8, the first medial support section 220 and second medial support section 224 each include a taper proximal the midfoot section 206 of the base 212.

Figure 9:
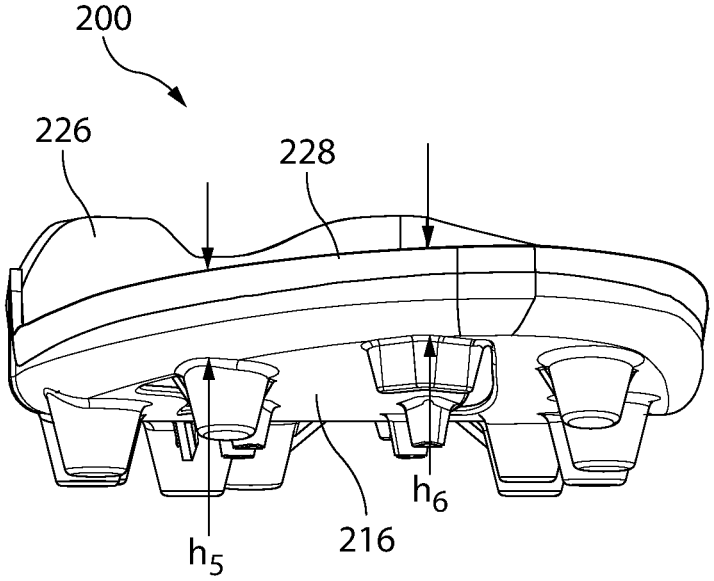
FIG. 9 is a front elevational view of the sole structure of the athletic cleat of FIG. 1A.
Figure 10:
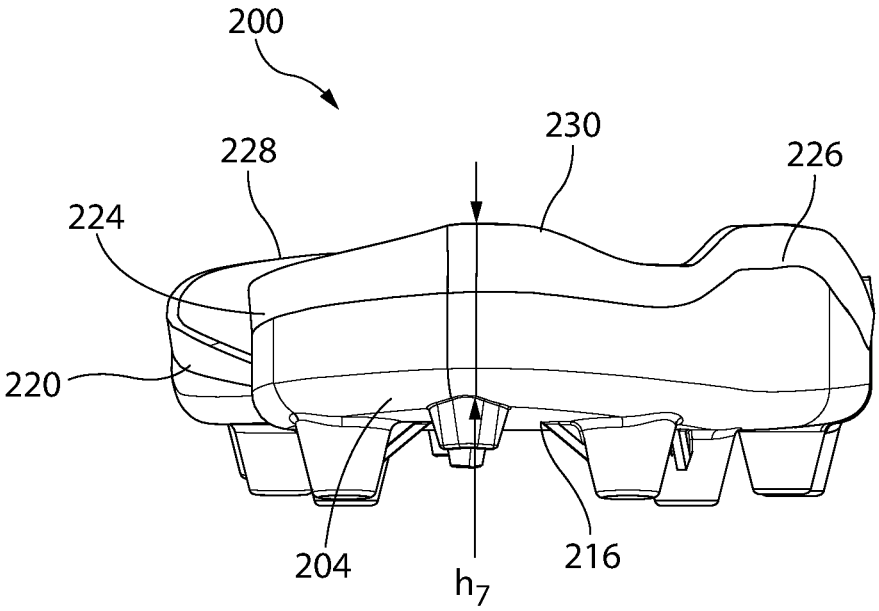
FIG. 10 is a rear elevational view of the sole structure of the athletic cleat of FIG. 1A.

Referring to FIGS. 9-10, the vertical sections (e.g., vertical section 228 and second vertical section 230) of support wall 219 that extend upwardly from the toe box 218 and heel section 204 may each extend upwardly from the base 212 at a predetermined height. In some embodiments, the height of each vertical sections corresponds to the size of the sole structure 200. For example, if the sole structure 200 is sized to correspond to a first common shoe size (e.g., U.S. men's size 11) the height of each of said vertical sections may be different from a sole structure sized to correspond to a second common shoe size (e.g., U.S. men's size 9). In some embodiments, the vertical section 228 extending around the periphery of the toe box 218 may have a first height $h_5$ extending in a vertical direction from the bottom surface 216 of the base 212 to a top surface of the vertical section 228.

In some embodiments, the vertical section 228 may have a second height $h_6$ extending in a vertical direction from the bottom surface 216 of the base 212 to a top surface of the vertical section 228 at a location generally central to the toe box 218 and/or proximate a user's second and/or third metatarsal. In some embodiments, the second height $h_6$ is substantially equal to the first height $h_5$. In other embodiments, the second height $h_6$ is greater than the first height $h_5$ by about 10% to about 40%. The height $h_5$ may be within a range of about 10.00 mm to about 20.00 mm depending on the size of the sole structure 200. The height $h_6$ may be within a range of about 10.00 mm to about 30.00 mm depending on the size of the sole structure 200. In some embodiments, the second vertical section 230 extending around the periphery of the heel section 204 may have a height $h_7$ extending in a vertical direction from the bottom surface 216 of the base 212 to a top surface of the second vertical section 230. In some embodiments, the height $h_7$ may be a maximum height of the second vertical section 230 and the second vertical section 230 may taper towards the second medial support section 224 and/or the second lateral support section 226. The height $h_7$ may be within a range of about 15.00 mm to about 40.00 mm depending on the size of the sole structure 200.

Figure 12:
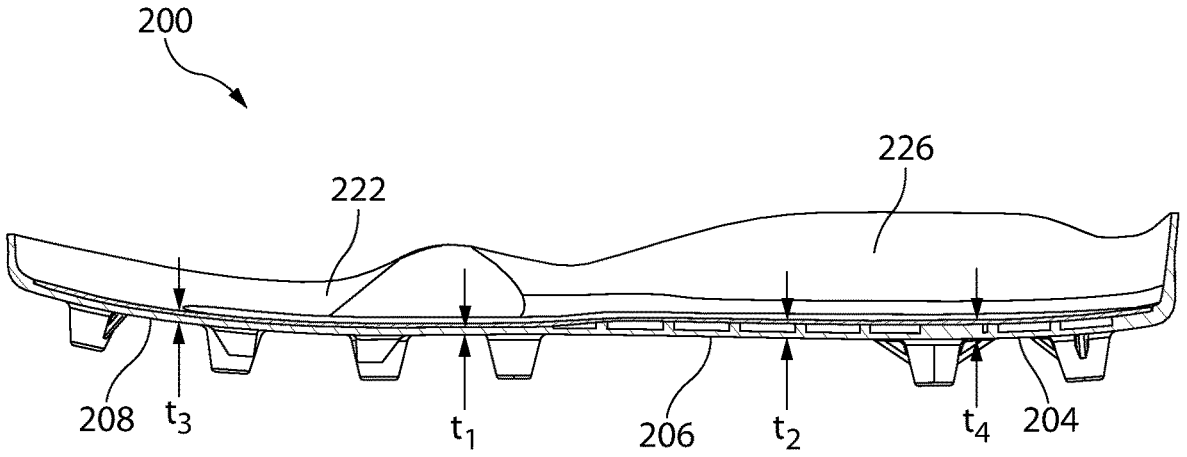
FIG. 12 is a right-side elevational cross-sectional view of the sole structure of the athletic cleat of FIG. 1A.

Referring to FIG. 12, the sole structure 200 may be configured to position the user's foot close to a ground surface in order to prevent the user's ankles from rolling during use of the athletic cleat 100. In some embodiments, the base 212 may have a thickness in a range between about 3 mm to about 6 mm. By providing a base 212 having a thickness in the above-mentioned range, the user's foot may be positioned close to a ground surface. In some embodiments, the thickness of the base 212 may vary between the forefoot section 208, midfoot section 206, and the heel section 204. In some embodiments, the midfoot section 206 may be at a first thickness $t_1$ proximal the forefoot section 208 and at a second thickness $t_2$ where the midfoot section 206 is proximal the heel section 204. In some embodiments, the first thickness $t_1$ is less than the second thickness $t_2$. In some embodiments, the first thickness $t_1$ is about the same as the second thickness $t_2$. In some embodiments, the first thickness $t_1$ is about 3 mm. In some embodiments the second thickness $t_2$ is about 5 mm. In some embodiments, the forefoot section 208 of the base 212 may have a thickness $t_3$. In some embodiments, the thickness $t_3$ is less than the first thickness $t_1$ of the midfoot section. In some embodiments, the thickness of the forefoot section 208 is about the same throughout the forefoot section 208. In some embodiments the thickness $t_3$ is about 3 mm. In some embodiments, the heel section 204 has a thickness $t_4$. In some embodiments, the thickness of the heel section 204 is about the same throughout the heel section 204. In some embodiments, the thickness $t_4$ of the heel section is greater than or equal to the first thickness $t_1$ of the forefoot section 208. In some embodiments the thickness $t_4$ is within a range of about 4.00 mm to about 5.00 mm.

Figure 13A:
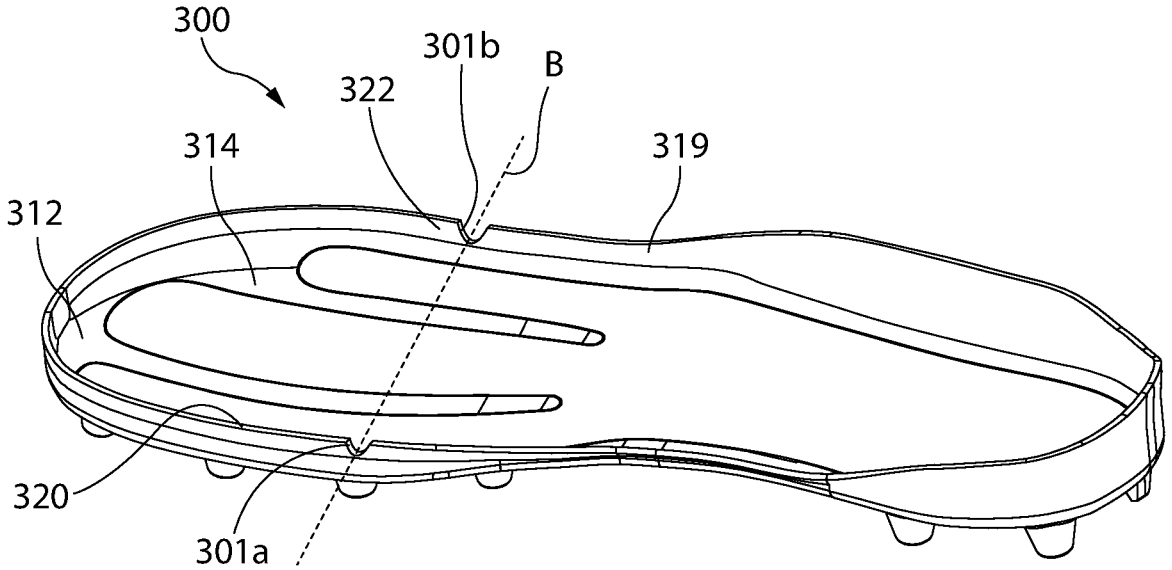
FIG. 13A is a perspective view of sole structure in accordance with another embodiment of the present disclosure.
Figure 13B:
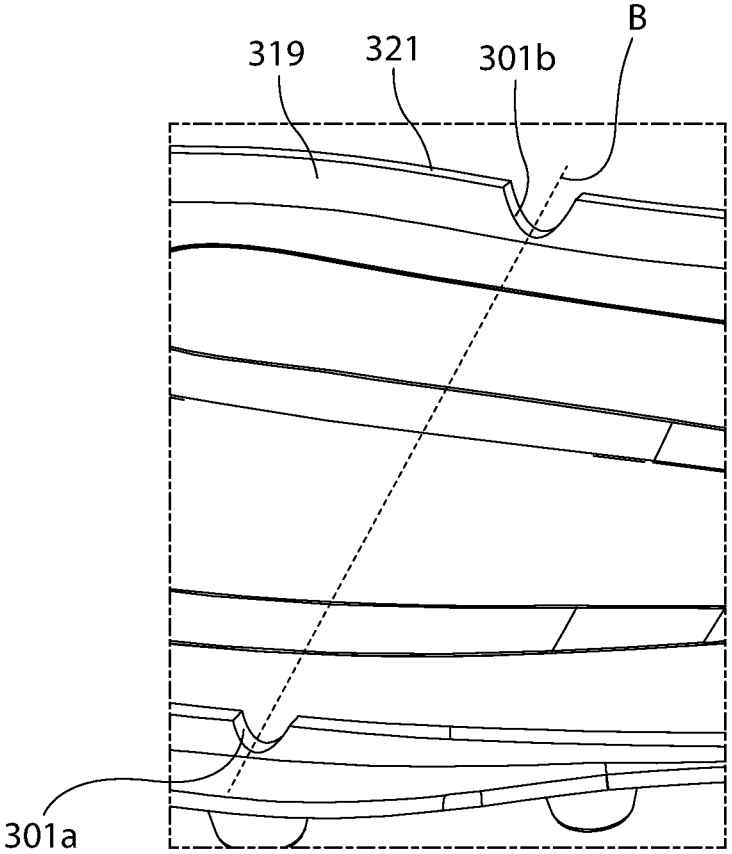
FIG. 13B is a magnified perspective view of the sole structure of FIG. 13A.

Referring to FIG. 13A-13B, there is shown a sole structure, generally designated 300, in accordance with another embodiment of the present disclosure. Sole structure 300 may be generally the same as sole structure 200 as discussed above with reference to FIGS. 1A-12, except that the support wall 319 of sole structure 300 may include notches 301*a* and 301*b* configured to allow the sole structure 300 to bend or flex about an axis B without causing the first medial or first lateral support sections 320 and 322 to splay or flex away from the user's foot when the sole structure 300 is bent about axis B. In some embodiments, the axis B may be generally aligned with a hinge line of a user's foot such as an imaginary line extending through the joints connecting the metatarsals and proximal phalanxes of a user's foot. Notches 301*a* and 301*b* may be positioned on the first medial and first lateral support sections 320 and 322 respectively. The notches 301*a* and 301*b* may have a generally U-shape or generally V-shape. In some embodiments, the notches 301*a* and 301*b* extend downwardly from a top surface 321 of support wall 319 at an angle of about 60°. In some embodiments, the notches 301*a* and 301*b* extend downwardly from the top surface 321 of support wall 319 at an angle less than 60°. In some embodiments, the notches 301*a* and 301*b* extend downwardly from top surface 321 of support wall 319 a distance which is less than the distance of the top surface 321 support wall 319 from the top surface 314 of base 312. In other embodiments, the notches 301*a* and 301*b* extend downwardly from top surface 321 of support wall 319 a distance that is generally equal to the distance of the top surface 321 to the top surface 314 of base 312. In some embodiments, the sole structure 300 may include either notch 301*a* or notch 301*b*.

Figure 15:
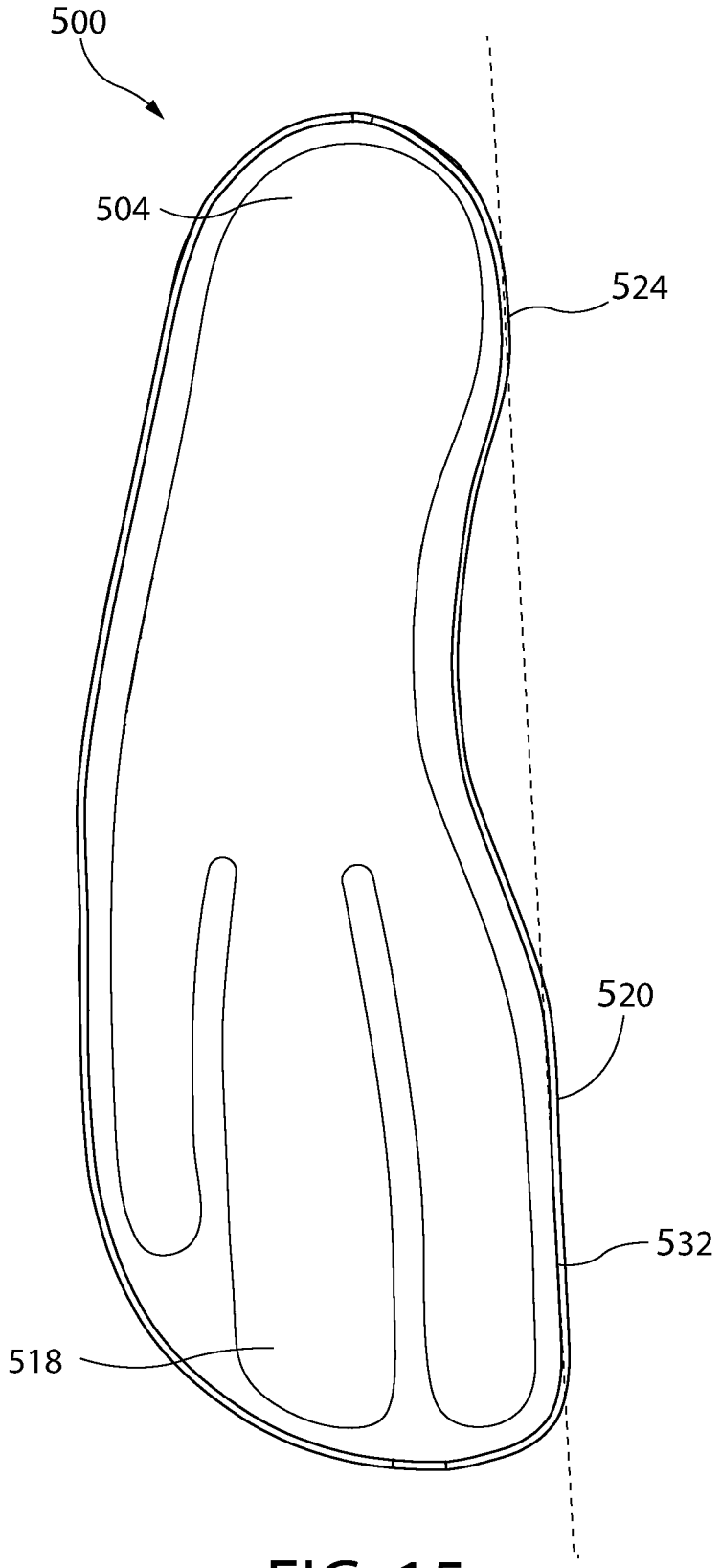
FIG. 15 is a top plan view of a sole structure in accordance with another embodiment of the present disclosure.

Referring to FIG. 15, there is shown a sole structure, generally designated 500, in accordance with another exemplary embodiment of the present disclosure. Sole structure 500 may be generally the same as sole structure 200 as discussed above with reference to FIGS. 1A-12, except that the position of heel section 504 relative to the toe box 518 may be different thereby resulting in a medial axis $M_2$ that is offset from the medial axis M discussed above. The inner side edge 532 of the first medial support section 520 may remain aligned with the medial axis $M_2$ in generally the same manner as described above with reference to FIGS. 4-5. In this manner, the toe box 518 of the sole structure 500 may provide generally the same benefits as the toe box 218 of the sole structure 200.

It will be appreciated by those skilled in the art that changes could be made to the exemplary embodiments shown and described above without departing from the broad inventive concepts thereof. It is understood, therefore, that this invention is not limited to the exemplary embodiments shown and described, but it is intended to cover modifications within the spirit and scope of the present invention as defined by the claims. For example, specific features of the exemplary embodiments may or may not be part of the claimed invention and various features of the disclosed embodiments may be combined. The words "inwardly" and "outwardly" refer to directions toward and away from, respectively, the geometric center of the sole structure. Unless specifically set forth herein, the terms "a", "an" and "the" are not limited to one element but instead should be read as meaning "at least one".

It is to be understood that at least some of the figures and descriptions of the invention have been simplified to focus on elements that are relevant for a clear understanding of the invention, while eliminating, for purposes of clarity, other elements that those of ordinary skill in the art will appreciate may also comprise a portion of the invention. However, because such elements are well known in the art, and because they do not necessarily facilitate a better understanding of the invention, a description of such elements is not provided herein.

Further, to the extent that the methods of the present invention do not rely on the particular order of steps set forth herein, the particular order of the steps should not be construed as limitation on the claims. Any claims directed to the methods of the present invention should not be limited to the performance of their steps in the order written, and one skilled in the art can readily appreciate that the steps may be varied and still remain within the spirit and scope of the present invention.

What is claimed is:

1. An athletic cleat comprising:

a sole structure including a base configured to receive a user's foot, the base having a top surface and a bottom surface opposed from the top surface, the base including a heel section, a midfoot section, a forefoot section, and a plurality of studs extending downwardly from the bottom surface; and a support wall extending around at least a portion of an outer periphery of the sole structure, the support wall including:

a first medial support section coupled to the forefoot section of the base and extending upwardly from the top surface of the base aligned with a medial axis that is tangent to an inner side edge of the heel section;

a first lateral support section coupled to and extending upwardly from the top surface of the forefoot section of the base opposite the first medial support section;

a second medial support section coupled to and extending upwardly from the heel section of the base and aligned with the medial axis; and a second lateral support section coupled to and extending upwardly from the heel section of the base opposite the second medial support section;

wherein the forefoot section includes a toe box configured to be positioned below toes of the user, the toe box including a medial inner side edge coincident with an entire length of the toe box, and a majority of the medial inner side edge coincident with the medial axis;

wherein a lateral side of the heel section and the midfoot section of the base form a convex curvature and the lateral side of the midfoot section includes a concave curvature where it meets a lateral side of the forefoot section;

wherein the first medial support section extends rearwardly from the medial inner side edge of the toe box and is configured to extend substantially along a length of a first metatarsal of the user's foot; and a portion of the first lateral support section extends rearwardly from the toe box along an axis and another portion of the first lateral support section extends at an acute angle thereto.

2. The athletic cleat of claim 1, wherein the toe box is positioned forward of the first medial support section and the first lateral support section, the support wall including a first vertical section extending around a periphery of the toe box from the first medial support section to the first lateral support section.

3. The athletic cleat of claim 2, wherein the support wall further includes: a second vertical section extending around a periphery of the heel section from the second medial support section to the second lateral support section.

4. The athletic cleat of claim 3, wherein the first medial support section, the first lateral support section, the second medial support section, the second lateral support section, the first vertical section and the second vertical section are integrally formed.

5. The athletic cleat of claim 1, wherein the first medial support section, the first lateral support section, the second medial support section, and the second lateral support section are configured to prevent the user's foot from being laterally displaced past an outer periphery of the base during lateral movements.

6. The athletic cleat of claim 1, wherein the first lateral support section extends rearwardly from the toe box and is concave.

7. The athletic cleat of claim 1, wherein the midfoot section includes a medial side having a concave curvature.

8. The athletic cleat of claim 1 further comprising:

a reinforcement member coupled to the top surface of the base and extending along the heel section, the midfoot section and the forefoot section.

9. The athletic cleat of claim 8, wherein the reinforcement member includes a first section extending along the heel section and the midfoot section, and three or more members extending from the first section along the forefoot section, the three or more members spaced from one another along a direction generally perpendicular to a transverse axis extending from the second medial support section and the second lateral support section.

10. The athletic cleat of claim 9, wherein the first section of the reinforcement member is configured to prevent the base from bending along a direction parallel to and perpendicular to the transverse axis.

11. The athletic cleat of claim 8, wherein the reinforcement member includes a first section extending along the heel section and the midfoot section, and three members extending from the first section along the forefoot section, each of the three members spaced from one another along a direction generally perpendicular to a transverse axis extending from the second medial support section and the second lateral support section.

12. The athletic cleat of claim 9, wherein the three or more members are each configured to prevent the base from bending along a longitudinal axis extending from the midfoot section to the forefoot section of the base.

13. The athletic cleat of claim 8, wherein the reinforcement member is comprised of a material that is more rigid than the sole structure.

14. The athletic cleat of claim 8, wherein the plurality of studs are coupled to a bottom surface of the base proximal the forefoot section and heel section, the plurality of studs proximal the toe box of the forefoot section aligned with an outer periphery of the reinforcement member, each stud of the plurality of studs having a generally frustoconical shape.

15. The athletic cleat of claim 1, wherein a total length of the sole structure is 2.7 times that of a total width of the toe box.

16. An athletic cleat comprising:

a sole structure comprising:

a base for receiving a user's foot, the base having a top surface and a bottom surface opposed from the bottom surface, the base including a heel section, a midfoot section, a forefoot section, and a plurality of studs extending downwardly from the bottom surface, the forefoot section including a toe box configured to be positioned below toes of the user, the toe box including a medial side edge coincident with an entire length of the toe box and a majority of the medial side edge coincident with a medial axis that is tangent to an outer edge of the heel section;

a support wall extending at least partially around a periphery of the base, the support wall comprising:

a first medial support section coupled to the forefoot section of the base and extending upwardly from the top surface of the base aligned with the medial axis, the first medial support section extending rearwardly from the medial side edge of the toe box and configured to extend substantially along a length of a first metatarsal of the user's foot;

a first lateral support section coupled to and extending upwardly from the forefoot section of the base opposite the first medial support section;

a second medial support section coupled to and extending upwardly from the heel section of the base; and a second lateral support section coupled to and extending upwardly from the heel section of the base opposite the second medial support section, a vertical section extending upwardly from and around a periphery of the toe box, the vertical section extending from the first medial support section to the first lateral support section; and an upper coupled to the sole structure and configured to cover the foot of the user wearing the athletic cleat, the upper comprised of a non-elastic material, wherein the midfoot section includes a lateral side having a convex curvature and an opposing medial side having a concave curvature, wherein a lateral side of the heel section and the midfoot section of the base form a convex curvature and the lateral side of the midfoot section includes a concave curvature where it meets a lateral side of the forefoot section.

17. The athletic cleat of claim 16, wherein the upper includes one or more pairs of apertures for receiving a shoelace, the one or more pairs of apertures configured to extend from above where a proximal phalanx of the user's toes meets a corresponding metatarsal of the user's foot to an opening in the upper configured to receive the user's foot.

18. The athletic cleat of claim 16, wherein the first lateral support section extends rearwardly from the toe box and is concave.

19. The athletic cleat of claim 16, wherein a total length of the sole structure is 2.7 times that of a total width of the toe box.

* * * * *